US010723134B2

(12) United States Patent
Koase et al.

(10) Patent No.: US 10,723,134 B2
(45) Date of Patent: Jul. 28, 2020

(54) LIQUID TANK

(71) Applicant: Seiko Epson Corporation, Tokyo (JP)

(72) Inventors: Takashi Koase, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 32 days.

(21) Appl. No.: 15/991,362

(22) Filed: May 29, 2018

(65) Prior Publication Data

US 2018/0345678 A1 Dec. 6, 2018

(30) Foreign Application Priority Data

May 31, 2017 (JP) ..... 2017-107824
Aug. 29, 2017 (JP) ..... 2017-164282

(51) Int. Cl.
*B41J 2/175* (2006.01)
*B41J 2/19* (2006.01)

(52) U.S. Cl.
CPC ..... *B41J 2/19* (2013.01); *B41J 2/175* (2013.01); *B41J 2/1752* (2013.01); *B41J 2/17513* (2013.01); *B41J 2/17523* (2013.01); *B41J 2/17553* (2013.01); *B41J 2/17556* (2013.01); *B41J 2/17559* (2013.01); *B41J 2/17563* (2013.01); *B41J 2/17596* (2013.01); *B41J 2202/07* (2013.01)

(58) Field of Classification Search
CPC .... B41J 2/175; B41J 2/17553; B41J 2/17523; B41J 2/1752; B41J 2/17563; B41J 2/17513; B41J 2/17596; B41J 2/17556; B41J 2/17503; B41J 2/17506; B41J 2/17509; B41J 2/17526
See application file for complete search history.

(56) References Cited

U.S. PATENT DOCUMENTS

| | | | |
|---|---|---|---|
| 8,246,153 | B2 | 8/2012 | Miyajima |
| 2010/0053284 | A1 | 3/2010 | Miyajima |
| 2010/0289856 | A1 | 11/2010 | Yamamoto et al. |

FOREIGN PATENT DOCUMENTS

| | | | |
|---|---|---|---|
| EP | 0 803 364 | A2 | 10/1997 |
| EP | 3 263 343 | A1 | 1/2018 |
| JP | 2010-052210 | A | 3/2010 |
| JP | 2016-155348 | A | 9/2016 |
| JP | 2017-081066 | A | 5/2017 |
| WO | WO-2016/136333 | A1 | 9/2016 |

*Primary Examiner* — Kristal Feggins
(74) *Attorney, Agent, or Firm* — Foley & Lardner LLP

(57) ABSTRACT

A liquid tank includes a liquid supply portion, a first liquid chamber, a liquid communication flow path and an air communication flow path. The liquid communication flow path includes an upstream end which is connected to the first liquid chamber, a rising flow path which is located on a downstream side with respect to the upstream end and which extends upward in a mounting state, a lowering flow path which is located on the downstream side with respect to the rising flow path and which extends downward in the mounting state and a downstream end which is located on the downstream side with respect to the lowering flow path and which is connected to the liquid supply portion. In the mounting state, the liquid supply portion is located lower than the downstream end and extends downward toward a liquid supply port.

17 Claims, 27 Drawing Sheets

LIQUID TANK

CROSS REFERENCE TO RELATED APPLICATIONS

This application claims priority based on Japanese Patent Application No. 2017-107824 filed on May 31, 2017 and Japanese Patent Application No. 2017-164282 filed on Aug. 29, 2017 the entire disclosures of which are hereby incorporated by reference.

BACKGROUND

Field

The present disclosure relates to a technology for liquid tanks.

Related Art

Conventionally, a technology is known that includes an ink tank which is arranged on a side surface of an ink jet-type recording device, a discharge head to which an ink is supplied from the ink tank and an ink supply path which communicates with the ink tank and the discharge head (JP 2016-155348 A).

In the conventional technology, a filter portion which stores the ink is arranged midway through a flow path from the ink supply path to the discharge head. The filter portion has the function of emitting bubbles by the suction of the ink from the side of the discharge head. In the conventional technology, due to the function of emitting bubbles, the structure of the filter portion may be complicated, and the filter portion may be increased in size. Hence, when the filter portion is removably mounted to a carriage, it is desirable to provide a technology which is able to suppress the increase in the size of the filter portion. When the structure of the filter portion is complicated, it is likely that the supply of the ink to the discharge head is not efficiently performed. Hence, it is desirable to provide a technology which is able to efficiently supply the ink to the discharge head.

In the conventional technology, the filter portion which includes a filter member for removing foreign substances is arranged midway through the flow path from the ink supply path to the discharge head. The filter portion has the bubble emission function of emitting bubbles by the suction of the ink from the side of the discharge head. In the conventional technology, due to the bubble emission function, the structure of the filter portion may be complicated, and the filter portion may be increased in size. Hence, when the ink tank which includes the filter portion is removably mounted to the carriage, it is desirable to provide a technology which is able to suppress the increase in the size of the ink tank. When the structure of the filter portion is complicated, it is likely that the supply of the ink to the discharge head is not efficiently performed. Hence, it is desirable to provide a technology which is able to efficiently supply the ink to the discharge head. When the bubbles in the ink tank reach the discharge head, a failure in the discharge of the discharge head may occur. Hence, conventionally, it is desirable to provide a technology which is able to reduce the possibility that the bubbles in the ink tank reach the discharge head.

SUMMARY

The present disclosure is made so as to solve at least part of the problems described above, and is able to be realized as aspects or application examples below.

(1) According to one aspect of the present disclosure, a liquid tank is provided which is mounted to a carriage including a liquid ejection head. The liquid tank includes: a liquid supply portion which includes a liquid supply port that receives a liquid introduction needle included in the liquid ejection head and to which the liquid introduction needle is connected; a first liquid chamber configured to store a liquid to be supplied to the liquid supply portion; a liquid communication flow path through which the first liquid chamber is in fluid communication with the liquid supply portion, the liquid communication flow path forming a flow path that is upwardly convex in a mounting state where the liquid tank is mounted to the carriage; and an air communication flow path through which the first liquid chamber is in communication with the liquid supply portion, the air communication flow path connected to the first liquid chamber in a position higher than a position of connection of the liquid communication flow path and the first liquid chamber in the mounting state, where, in a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion, and in the mounting state, the liquid supply portion is located lower than the downstream end and extends downward toward the liquid supply port.

In this aspect, the liquid supply portion is located, in the mounting state, lower than the downstream end and extends downward toward the liquid supply port. In this way, it is possible to suppress an increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head.

(2) In the aspect described above, the liquid tank may further include: a second liquid chamber configured to store the liquid to be supplied to the first liquid chamber; a connection flow path which connects the first liquid chamber and the second liquid chamber together and which is configured to supply the liquid in the second liquid chamber to the first liquid chamber; a liquid filling portion through which the liquid is filled into the second liquid chamber; and an atmosphere communication portion which makes the second liquid chamber communicate with the atmosphere. In this aspect, the liquid tank includes the atmosphere communication portion so as to be able to make air within the second liquid chamber flow to the outside when the liquid is filled from the liquid filling portion into the second liquid chamber. In this way, it is possible to reduce the possibility that the air (bubbles) flows from the second liquid chamber into the first liquid chamber.

(3) In the aspect described above, the connection flow path may include an inlet opening portion which forms one end and which is connected to the first liquid chamber, the liquid tank may further include a valve mechanism which opens and closes the inlet opening portion so as to control the flow of the liquid from the second liquid chamber into the first liquid chamber and the inlet opening portion may be arranged in a position lower than the upstream end in the mounting state. Here, the liquid may contain a component which makes contact with a gas and receives a pressure variation caused by the opening and closing of the valve mechanism and which is thereby agglomerated so as to become a foreign substance. In this aspect, in the mounting state, the inlet opening portion is arranged in the position lower than the upstream end, and thus it is possible to suppress the lowering of the water level of the liquid beyond the inlet opening portion. Hence, it is possible to reduce the presence of gas around the inlet opening portion, and thus it is possible to reduce the possibility that foreign substances appear around the inlet opening portion. In this way, it is possible to reduce the possibility that foreign substances flow into the liquid ejection head.

(4) In the aspect described above, the valve mechanism may be brought into an opened state at least when the interior of the first liquid chamber has a negative pressure. In this aspect, it is possible to stabilize the opening/closing operation of the valve mechanism.

(5) In the aspect described above, the first liquid chamber may be smaller in volume than the second liquid chamber. In this aspect, since the first liquid chamber is smaller in volume than the second liquid chamber, when the air in the first liquid chamber is sucked and emitted to the liquid ejection head, it is possible to reduce the amount of air sucked. In this way, it is possible to reduce the time in which the air is sucked.

(6) In the aspect described above, the liquid tank may further include a tank main body which includes a wall, where the first liquid chamber, the liquid communication flow path and the air communication flow path are formed on one side of the wall, and the second liquid chamber is formed on the other side opposite to the one side of the wall. In this aspect, it is possible to arrange the first liquid chamber and the second liquid chamber by efficiently utilizing the space in the liquid tank, and thus it is possible to suppress the increase in the size of the liquid tank.

(7) In the aspect described above, when the liquid tank is seen from the one side of the side wall, the liquid filling portion and the liquid supply port may be arranged in diagonal positions. In this aspect, since it is possible to suppress the shortening of a distance from the liquid filling portion to the liquid supply port, even if the bubbles appear when the liquid is filled from the liquid filling portion into the second liquid chamber, it is possible to reduce the possibility that the bubbles reach the liquid supply port. In this way, it is possible to reduce the bubbles retained in the vicinity of the liquid supply port within the liquid supply portion, and thus it is possible to reduce the possibility that the bubbles flow into the liquid ejection head. Since it is possible to efficiently arrange the flow paths along which the liquid is supplied from the liquid filling portion to the liquid supply port, it is possible to suppress the increase in the size of the liquid tank.

(8) In the aspect described above, the connection flow path may include a filter chamber which is connected to the second liquid chamber and which is located lower than the second liquid chamber in the mounting state, and the filter chamber includes, in the mounting state, an inflow opening which is connected to the second liquid chamber; and a filter member which partitions the filter chamber into a first portion that is located in an upper side including the inflow opening and a second portion that is located in a lower side with respect to the first portion and which is located lower than the inflow opening. In this aspect, it is possible to guide the bubbles adhered to the filter into the second liquid chamber, and thus it is possible to reduce the possibility that the bubbles flow out to the first liquid chamber and the liquid supply portion.

(9) In the aspect described above, the air communication flow path may be connected to an uppermost portion of the first liquid chamber in the mounting state. In this aspect, it is possible to reduce the possibility that the liquid flows into the air communication flow path. It is also possible to make the air on the side of the liquid supply portion smoothly flow into the first liquid chamber through the air communication flow path.

(10) According to another aspect of the present disclosure, a liquid tank is provided which is removably mounted to a carriage including a liquid ejection head. The liquid tank includes: a liquid supply portion which includes a liquid supply port that receives a liquid introduction needle portion included in the liquid ejection head and to which the liquid introduction needle portion is removably connected; a first liquid chamber which is able to store a liquid that is supplied to the liquid supply portion; a liquid communication flow path which connects the first liquid chamber and the liquid supply portion together, which is able to supply the liquid in the first liquid chamber to the liquid supply portion and which forms, in a mounting state where the liquid tank is mounted to the carriage, a flow path that is upwardly convex; and an air communication flow path which connects the first liquid chamber and the liquid supply portion together, which allows air communication between the first liquid chamber and the liquid supply portion and which is connected, in the mounting state, to the first liquid chamber in a position higher than a position of connection of the liquid communication flow path and the first liquid chamber. In a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port, the air communication flow path includes an air side connection portion which is connected to the uppermost portion of the first liquid chamber and in the mounting state, the position of the air side connection portion is the same position as a liquid side uppermost portion which is the highest position of the liquid communication flow path or is a position higher than the liquid side uppermost portion.

In this aspect, the liquid supply portion is located, in the mounting state, lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. Moreover, in this aspect, the liquid tank includes the air side connection portion which is connected to the uppermost portion of the first liquid chamber and in the mounting state, the position of the air side connection portion is the same position as the liquid side uppermost portion which is the highest position of the liquid communication flow path or is a position higher than the liquid side uppermost portion. In this way, as compared with a case where the position of the air side connection portion is lower than the position of the liquid side uppermost portion, it is possible to increase the volume of the uppermost portion of the first liquid chamber.

(11) In the aspect described above, the liquid side uppermost portion may include a tapered portion whose flow path cross-sectional area decreases as the tapered portion extends upward in the mounting state. In this aspect, since the liquid side uppermost portion includes the tapered portion whose flow path cross-sectional area decreases as the tapered portion extends upward, it is possible to increase the volume of the uppermost portion of the first liquid chamber while reducing an increase in the size of the first liquid chamber.

(12) According to another aspect of the present disclosure, a liquid tank is provided which is removably mounted to a carriage including a liquid ejection head. The liquid tank includes: a liquid supply portion which includes a liquid supply port that receives a liquid introduction needle portion included in the liquid ejection head and to which the liquid introduction needle portion is removably connected; a first liquid chamber which is able to store a liquid that is supplied to the liquid supply portion; a liquid communication flow path which connects the first liquid chamber and the liquid supply portion together, which is able to supply the liquid in the first liquid chamber to the liquid supply portion and which forms a flow path that is upwardly convex in a mounting state where the liquid tank is mounted to the carriage; and an air communication flow path which connects the first liquid chamber and the liquid supply portion together, which allows air communication between the first liquid chamber and the liquid supply portion and which is connected to the first liquid chamber in a position higher than a position of connection of the liquid communication flow path and the first liquid chamber in the mounting state. In a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port and the air communication flow path includes, in the mounting state, a rising air flow path which extends upward from the first liquid chamber and an inclined air flow path which is connected to the rising air flow path and which extends in a direction that is inclined with respect to a horizontal direction.

In this aspect, in the mounting state, the liquid supply portion is located lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. The air communication flow path includes, in the mounting state, the rising air flow path which extends upward from the first liquid chamber and the inclined air flow path which is connected to the rising air flow path and which extends in a direction that is inclined with respect to the horizontal direction. In this way, as compared with a case where the inclined air flow path extends in a direction along the horizontal direction, when the liquid flows into the inclined air flow path, it is possible to suppress the liquid which has flowed thereinto from being retained in the inclined air flow path.

(13) In the aspect described above, in the mounting state, the inclined air flow path may be inclined at an angle equal to or more than 10° but equal to or less than 45° with respect to the horizontal direction. In this aspect, with the inclined air flow path which is inclined at an angle equal to or more than 10° but equal to or less than 45° with respect to the horizontal direction, it is possible to further suppress the liquid from being retained in the inclined air flow path.

(14) According to another aspect of the present disclosure, a liquid tank is provided which is removably mounted to a carriage including a liquid ejection head. The liquid tank includes: a liquid supply portion which includes a liquid supply port that receives a liquid introduction needle portion included in the liquid ejection head and to which the liquid introduction needle portion is removably connected; a first liquid chamber which is able to store a liquid that is supplied to the liquid supply portion; a liquid communication flow path which connects the first liquid chamber and the liquid supply portion together, which is able to supply the liquid in the first liquid chamber to the liquid supply portion and which forms a flow path that is upwardly convex in a mounting state where the liquid tank is mounted to the carriage; and an air communication flow path which connects the first liquid chamber and the liquid supply portion together, which allows air communication between the first liquid chamber and the liquid supply portion and which is connected to the first liquid chamber in a position higher than a position of connection of the liquid communication flow path and the first liquid chamber in the mounting state. In a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port and flow path cross-sectional area of the liquid communication flow path is larger in than that of the air communication flow path.

In this aspect, in the mounting state, the liquid supply portion is located lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. Moreover, in this aspect, the liquid communication flow path is larger in flow path cross-sectional area than the air communication flow path. In this way, as compared with a case where flow path cross-sectional area of the liquid communication flow path is equal to or smaller than that of the air communication flow path, the liquid stored in the first liquid chamber easily flows to the liquid communication flow path. Hence, it is possible to suppress the liquid stored in the first liquid chamber from flowing into the air communication flow path.

(15) According to another aspect of the present disclosure, a liquid tank is provided which is removably mounted to a carriage including a liquid ejection head. The liquid tank includes: a liquid supply portion which includes a liquid supply port that receives a liquid introduction needle portion included in the liquid ejection head and to which the liquid introduction needle portion is removably connected; a first liquid chamber which is able to store a liquid that is supplied to the liquid supply portion; a liquid communication flow path which connects the first liquid chamber and the liquid supply portion together, which is able to supply the liquid in the first liquid chamber to the liquid supply portion and which forms, in a mounting state where the liquid tank is mounted to the carriage, a flow path that is upwardly convex; and an air communication flow path which connects the first liquid chamber and the liquid supply portion together, which allows air communication between the first liquid chamber and the liquid supply portion and which is connected to the first liquid chamber in a position higher than a position of connection of the liquid communication flow path and the first liquid chamber in the mounting state. In a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port and in the mounting state, the downstream end of the air communication flow path is located immediately above the liquid supply portion.

In this aspect, in the mounting state, the liquid supply portion is located lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. In the mounting state, the downstream end of the air communication flow path is located immediately above the liquid supply portion. In this way, as compared with a case where the downstream end of the air communication flow path is not located immediately above the liquid supply portion, bubbles within the liquid supply portion easily flow into the air communication flow path. Hence, it is possible to suppress the bubbles within the liquid supply portion from flowing into the liquid communication flow path.

(16) According to another aspect of the present disclosure, a liquid tank is provided which is mounted to a carriage including a liquid ejection head. The liquid tank includes: a liquid supply portion which includes a liquid supply port that receives a liquid introduction needle included in the liquid ejection head; a first liquid chamber configured to store a liquid to be supplied to the liquid supply portion; a liquid communication flow path through which the first liquid chamber is in communication with the liquid supply portion, and the liquid communication flow path forms a flow path that is upwardly convex in a mounting state where the liquid tank is mounted to the carriage; and an air communication flow path through which the first liquid chamber is in communication with the liquid supply portion, the air communication flow path is connected to the first liquid chamber in a position higher than a position of connection of the liquid communication flow path and the first liquid chamber in the mounting state. In a direction of flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port and in the mounting state, a downstream end portion including the downstream end of the liquid communication flow path is inclined with respect to the horizontal direction such that the downstream end portion extends upward as the downstream end portion comes closer to the liquid supply portion.

In this aspect, in the mounting state, the liquid supply portion is located lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. Moreover, in this aspect, in the mounting state, the downstream end portion including the downstream end of the liquid communication flow path is inclined with respect to the horizontal direction such that the downstream end portion extends upward as the downstream end portion comes closer to the liquid supply portion. In this way, as compared with a case where the downstream end portion is not inclined with respect to the horizontal direction such that the downstream end portion extends upward as the downstream end portion comes closer to the liquid supply portion, it is possible to suppress the bubbles within the liquid supply portion from flowing into the liquid communication flow path.

(17) In the aspect described above, in the mounting state, the downstream end portion may be inclined at an angle equal to or more than 10° but equal to or less than 45° with respect to the horizontal direction. In this aspect, in the mounting state, the downstream end portion is inclined at an angle equal to or more than 10° but equal to or less than 45° with respect to the horizontal direction, and thus it is possible to supply the liquid in the first liquid chamber to the liquid supply portion through the liquid communication flow path, and to suppress the bubbles within the liquid supply portion from flowing into the liquid communication flow path.

(18) According to another aspect of the present disclosure, a liquid tank is provided which is mounted to a carriage including a liquid ejection head. The liquid tank includes: a liquid supply portion which includes a liquid supply port that receives a liquid introduction needle included in the liquid ejection head; a first liquid chamber configured to store a liquid to be supplied to the liquid supply portion; a liquid communication flow path through which the first liquid chamber is in fluid communication with the liquid supply portion, and the liquid communication flow path forms a flow path that is upwardly convex in a mounting state where the liquid tank is mounted to the carriage; an air communication flow path through which the first liquid chamber is in communication with the liquid supply portion, and the air communication flow path is connected to the first liquid chamber in a position higher than a position of connection of the liquid communication flow path and the first liquid chamber in the mounting state; a second liquid chamber which communicates with the first liquid chamber and configured to store the liquid to be supplied to the first liquid chamber; a filter chamber which is connected through a filter to a bottom surface of the second liquid chamber and which is located lower than the second liquid chamber; and an intermediate flow path which connects the first liquid chamber and the filter chamber together in the mounting state. In a direction of the flow of the liquid from the liquid tank toward the liquid ejection head, the liquid communication flow path includes: an upstream end which is connected to the first liquid chamber; a rising flow path which is located on a downstream side with respect to the upstream end and which extends upward in the mounting state; a lowering flow path which is located on the downstream side with respect to the rising flow path and which extends downward in the mounting state; and a downstream end which is located on the downstream side with respect to the lowering flow path and which is connected to the liquid supply portion; in the mounting state, the liquid supply portion is located lower than the downstream end and extends downward toward the liquid supply port and the intermediate flow path includes a flow path which extends, in the mounting state, in a direction along a vertical direction.

In this aspect, in the mounting state, the liquid supply portion is located lower than the downstream end and extends downward toward the liquid supply port. In this way, it is possible to suppress the increase in the size of the liquid tank in the horizontal direction. Moreover, in this way, it is possible to smoothly supply the liquid from the liquid supply portion to the liquid ejection head, and thus it is possible to efficiently supply the liquid to the liquid ejection head. In this aspect, the intermediate flow path includes a flow path which extends, in the mounting state, in the direction along the vertical direction. In this way, as compared with a case where the intermediate flow path is a flow path which extends in a direction intersecting the vertical direction, it is possible to shorten the flow path length.

(19) According to another aspect of the present disclosure, a liquid tank is provided which is mounted to a carriage including a liquid ejection head. The liquid tank includes: a liquid supply portion which includes a liquid supply port that receives a liquid introduction needle included in the liquid ejection head; a first liquid chamber configured to store a liquid to be supplied to the liquid supply portion; a second liquid chamber which communicates with the first liquid chamber and configured to store the liquid to be supplied to the first liquid chamber; a filter chamber which is connected to a bottom surface of the second liquid chamber and which is located lower than the second liquid chamber; a filter which is arranged between the second liquid chamber and the filter chamber; and an intermediate flow path which connects the first liquid chamber and the filter chamber together. In a mounting state where the liquid tank is mounted to the carriage, the intermediate flow path includes a flow path which runs along a vertical direction.

In this aspect, the intermediate flow path is a flow path which runs along the vertical direction in the mounting state. In this way, as compared with a case where the intermediate flow path is a flow path which intersects the vertical direction, it is possible to shorten the flow path length.

The present disclosure is able to be realized in various aspects other than the liquid tank. For example, the present disclosure is able to be realized in aspects such as a method of manufacturing a liquid tank and a liquid ejection apparatus which includes a liquid tank.

DETAILED DESCRIPTION

A. First Embodiment

Figure 1:
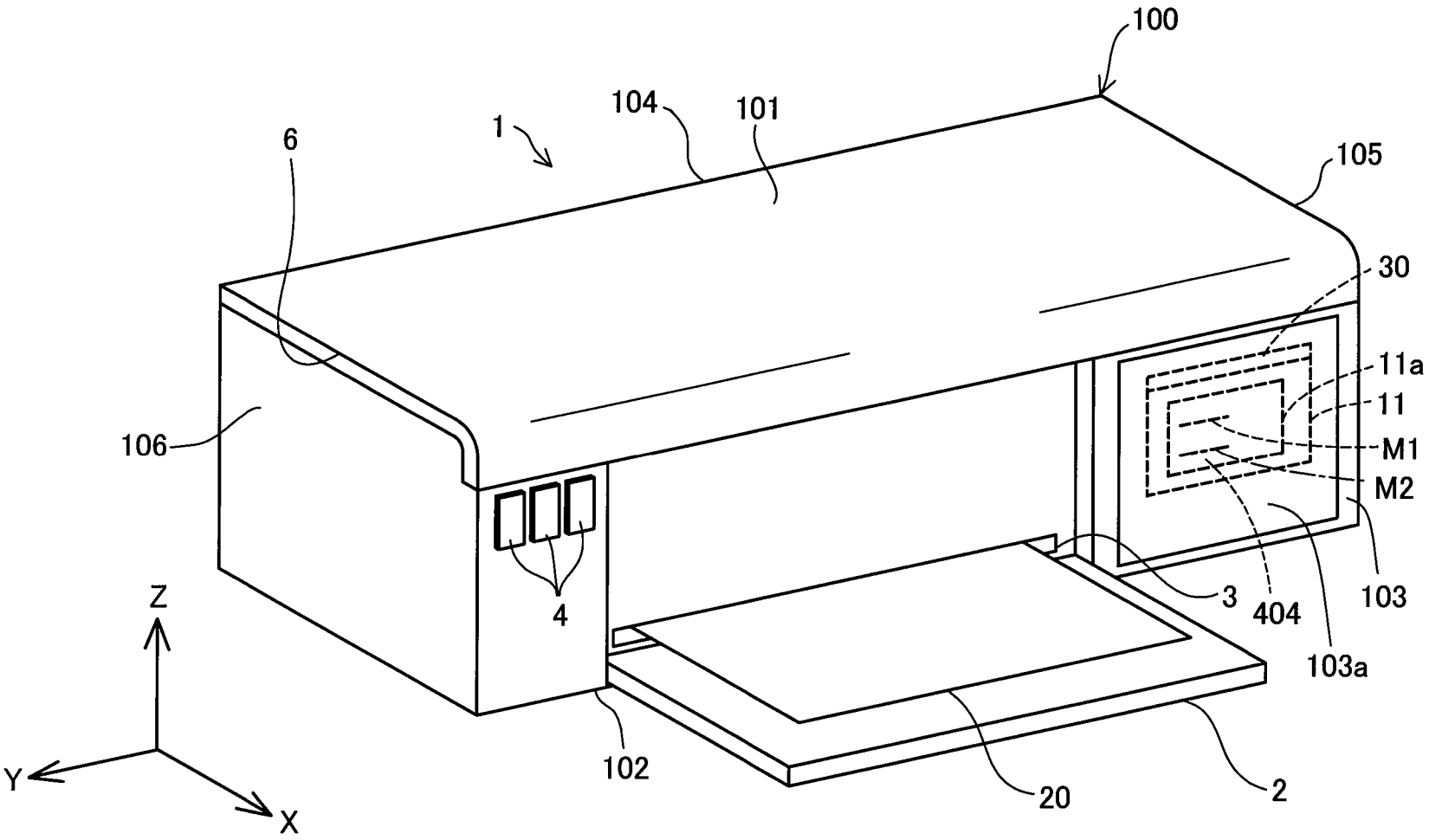
FIG. 1 is an external view of a liquid ejection apparatus which includes a liquid tank according to a first embodiment of the present disclosure.

A-1. Configuration of Liquid Ejection Apparatus:

FIG. 1 is an external view of a liquid ejection apparatus 1 which includes a liquid tank according to a first embodiment of the present disclosure. In FIG. 1. an X axis, a Y axis and a Z axis are shown which are three spatial axes orthogonal to each other. A direction along the X axis is assumed to be an X axis direction, a direction along the Y axis is assumed to be a Y axis direction and a direction along the Z axis is assumed to be a Z axis direction (up/down direction). The liquid ejection apparatus 1 is installed on a plane (XY plane) parallel to the X axis direction and the Y axis direction. A plus Z axis direction is a vertically upward direction, and a minus Z axis direction is a vertically downward direction. In other diagrams which will be described later, as necessary, the X axis, the Y axis and the Z axis are provided.

The liquid ejection apparatus 1 is a so-called inkjet printer, and ejects an ink serving as a liquid on a recording medium such as a sheet so as to perform printing. The liquid ejection apparatus 1 of the present embodiment is a printer which uses a black ink serving as a liquid so as to perform black and white printing.

The liquid ejection apparatus 1 includes an outer shell 100 which forms outer surfaces. The outer shell 100 is formed substantially in the shape of a cuboid, and includes an upper surface (a first surface, a first wall) 101, a lower surface (a second surface, a second wall) 102, a front surface (a third surface, a third wall) 103, a back surface (a fourth surface, a fourth wall) 104, a right side surface (a fifth surface, a fifth wall) 105 and a left side surface (a sixth surface, a sixth wall) 106. The upper surface 101 and the lower surface 102 are opposite each other in the Z axis direction. The front surface 103 and the back surface 104 are opposite each other in the X axis direction. The right side surface 105 and the left side surface 106 are opposite each other in the Y axis direction. The front surface 103, the back surface 104, the right side surface 105 and the left side surface 106 each are surfaces which are substantially vertical with respect to the installation plane of the liquid ejection apparatus 1. The upper surface 101 and the lower surface 102 each are surfaces which are substantially horizontal with respect to the installation plane of the liquid ejection apparatus 1. In the present embodiment, "substantially vertical" or "substantially horizontal" includes not only a meaning of completely "vertical" or "horizontal" but also a meaning of approximately "vertical" or "horizontal". In other words, the individual surfaces 101 to 106 do not need to be completely flat surfaces, and may allow projections and recesses and the like so as to be approximately "vertical" or "horizontal" in appearance.

The liquid ejection apparatus 1 further includes a front surface cover 2, a discharge port 3, an operation portion 4 and an upper surface cover 6. The front surface cover 2 forms part of the front surface 103, is supported with a shaft in a lower end portion and is able to be opened or closed by turning the side of an upper end portion. In FIG. 1, the front surface cover 2 is in an opened state. The front surface cover 2 is opened, and thus the discharge port 3 is exposed.

The discharge port 3 is a portion through which the recording medium is discharged. The recording medium may be arranged on a tray (not shown) provided on the side of the back surface 104. While the recording medium arranged on the tray is being transported into the outer shell 100, the liquid is ejected to the recording medium, and thus printing on the recording medium is performed.

The operation portion 4 is buttons which receive various types of operations from a user. Examples of various types of operations include an operation for starting the printing of the liquid ejection apparatus 1 and an operation for performing an emission operation to emit, to the outside, fluids within the liquid tank which will be described later.

The upper surface cover 6 forms the upper surface 101. The end portion of the upper surface cover 6 on the side of the back surface 104 is supported with a shaft, and the upper surface cover 6 is able to be opened or closed by turning the side of the front surface 103. By opening the upper surface cover 6, it is possible to check the internal state of the liquid ejection apparatus 1, to perform an operation of fitting and removing the liquid tank which will be described later and to fill the liquid into the liquid tank.

In the front surface 103, in the Y axis direction (the reciprocation direction of a carriage 19 which will be described later), a device side window portion 103*a* is formed in a region overlapping the home position of a carriage 19. In the present embodiment, the device side window portion 103*a* is arranged in a position different from the front surface cover 2 and on the minus side of the Y axis direction with respect to the front surface cover 2. The device side window portion 103*a* is provided so that the front surface (visual recognition surface) 404 of the liquid tank 30 mounted to the carriage 19 located in the home position is visually recognized from the outside by the user. On the front surface 404, a mark M1 is provided. For example, the device side window portion 103*a* may be a through hole which penetrates the front surface 103 or may be a transparent member. The mark M1 is an element for indicating a standard on the water level of the liquid stored in the liquid tank 30, and in the present embodiment, indicates an upper limit standard. The details of the mark M1 will be described later. When the front surface 404 of the liquid tank 30 in the home position is able to be visually recognized from the outside, the device side window portion 103*a* does not need to be provided on the front surface 103. For example, the device side window portion 103*a* may be provided on the upper surface 101. In this case, the user visually recognizes the device side window portion 103*a* from an upwardly front side, and thus the user is able to visually recognize the front surface 404. In a second embodiment which will be described later, not only the mark M1 but also a mark M2 is provided on the front surface 404. The mark M2 is an element for indicating a standard on the water level of the liquid stored in the liquid tank 30. In the second embodiment which will be described later, the mark M1 indicates the upper limit standard, and the mark M2 indicates a lower limit standard. The details of the mark M2 will be described later.

Figure 2:
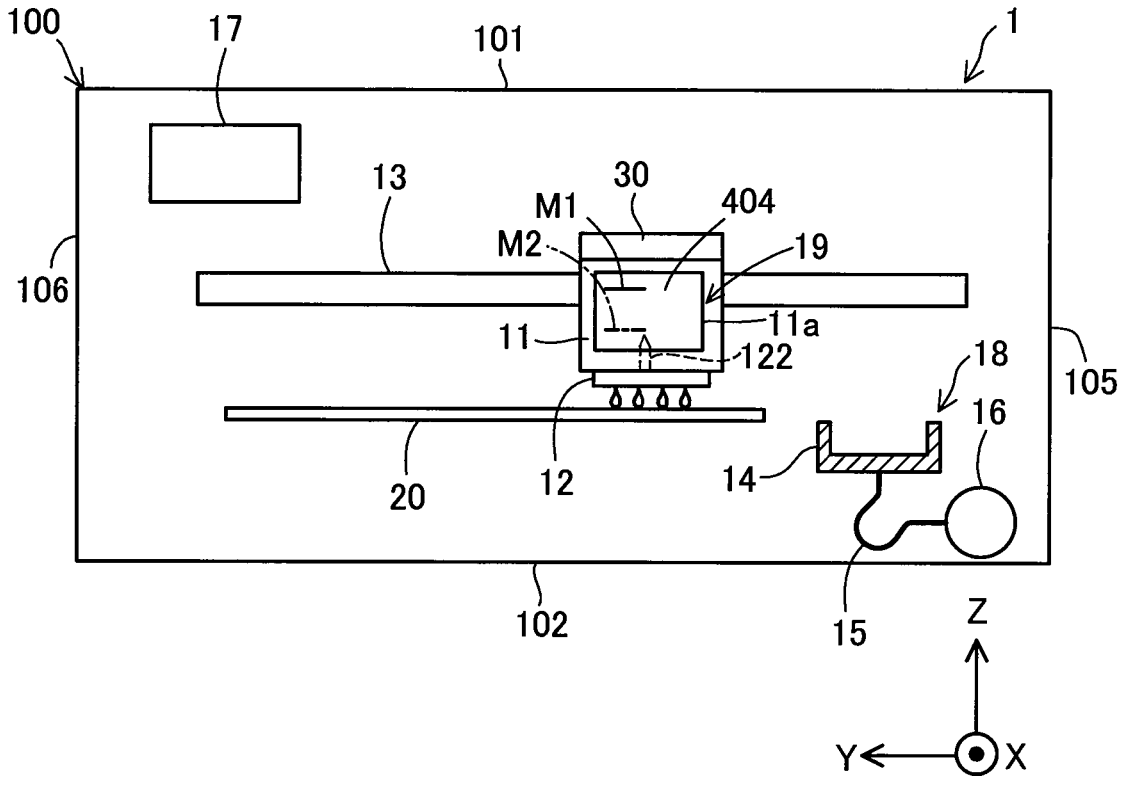
FIG. 2 is a schematic view showing the internal configuration of the liquid ejection apparatus.

FIG. 2 is a schematic view showing the internal configuration of the liquid ejection apparatus 1. The liquid ejection apparatus 1 includes, within the outer shell 100, a control portion 17, the carriage 19 which includes a liquid ejection head 12 and the liquid tank 30 which is removably mounted to the carriage 19. The control portion 17 controls various types of operations (for example, a printing operation) of the liquid ejection apparatus 1.

The carriage 19 includes a mounting portion 11 which is arranged on the liquid ejection head 12. The mounting portion 11 is formed in, for example, a concave shape that is opened in the plus Z axis direction so as to form a fitting space to which the liquid tank 30 is fitted. The mounting portion 11 includes a liquid introduction needle portion 122 which protrudes to the plus side of the Z axis direction from a lower surface partitioning the fitting space. The liquid introduction needle portion 122 is connected to the liquid tank 30. The liquid introduction needle portion 122 is hollow, and a communication hole which communicates with the inside thereof is formed at the side of a tip end. Within the liquid introduction needle portion 122, the liquid, which is supplied from the liquid tank 30 through the communication hole of the liquid introduction needle portion 122, is supplied. The liquid ejection head 12 communicates with the liquid introduction needle portion 122, and ejects the liquid (in the present embodiment, the black ink) supplied from the liquid tank 30 to the recording medium 20 (for example, a print sheet).

The mounting portion 11 includes a mounting portion side window portion 11*a* for the visual recognition of the front surface (visual recognition surface) 404 including the mark M1 by the user. The mounting portion side window portion 11*a* is provided in a position opposite at least the mark M1 of the liquid tank 30. For example, the mounting portion side window portion 11*a* may be a through hole which penetrates a wall forming the mounting portion 11 or may be a transparent member. When the carriage 19 is located in the home position, through the device side window portion 103*a* (FIG. 1) and the mounting portion side window portion 11*a*, the user is able to visually recognize the front surface (visual recognition surface) 404 having the mark M1. In the second embodiment which will be described later, the mounting portion side window portion 11*a* of the mounting portion 11 is an element for the visual recognition of the front surface (visual recognition surface) 404 having the marks M1 and M2 by the user. In other words, in the second embodiment which will be described later, when the carriage 19 is located in the home position, through the device side window portion 103*a* (FIG. 1) and the mounting portion side window portion 11*a*, the user is able to visually recognize the front surface (visual recognition surface) 404 having the marks M1 and M2.

The carriage 19 of the liquid ejection head 12 is driven by a drive mechanism (not shown), and repeatedly reciprocates on the recording medium 20 while being guided by a guide rail 13 which extends in the Y axis direction. The liquid ejection apparatus 1 includes a transportation mechanism for transporting the recording medium 20 toward the discharge port 3 (FIG. 1). The liquid is ejected from the liquid ejection head 12 according to the movement of the reciprocation of the carriage 19 and the movement of the transportation of the recording medium 20, and thus an image and the like is printed on the recording medium 20.

The liquid tank 30 stores the liquid which is supplied to the liquid ejection head 12. In the present embodiment, the liquid stored is black ink in which pigment particles are dissolved in a solvent. The liquid tank 30 is removably connected to the liquid introduction needle portion 122. The liquid tank 30 is connected to the liquid introduction needle portion 122, and thus the liquid in the liquid tank 30 is able to be supplied to the liquid introduction needle portion 122.

The liquid ejection apparatus 1 further includes an emission portion 18 which performs an operation (emission operation) for periodically sucking the fluids (for example, a liquid and air) from the liquid ejection head 12.

The emission portion 18 is arranged within the outer shell 100. The emission portion 18 includes a cap 14, a suction tube 15 and a suction pump 16. While the liquid ejection apparatus 1 does not perform the printing operation, the carriage 19 is arranged in the home position which is a position displaced from a movement region in the printing operation.

The cap 14 is a box-shaped member which is arranged below the home position and which has a bottom surface. The cap 14 is able to be moved in the Z axis direction (up/down direction) by a raising/lowering mechanism (not shown). The cap 14 is raised so as to be pressed onto the side of the lower surface of the liquid ejection head 12. In this way, the cap 14 forms a closed space (closed space state) so as to cover nozzle holes formed in the lower surface of the liquid ejection head 12. With this closed space, it is possible to suppress drying of the ink within the liquid ejection head 12 (nozzles).

The suction tube 15 makes the cap 14 (specifically, a through hole formed in the bottom surface of the cap 14) and the suction pump 16 communicate with each other. The suction pump 16 is driven in the closed space state so as to suck, through the suction tube 15, the fluids (the liquid and the air) in the liquid ejection head 12 and the liquid tank 30. In this way, it is possible to perform the initial charging of the liquid to the liquid ejection head 12 and to suck the liquid (liquid whose viscosity is increased by being dried) deteriorated within the liquid ejection head 12.

Figure 3:
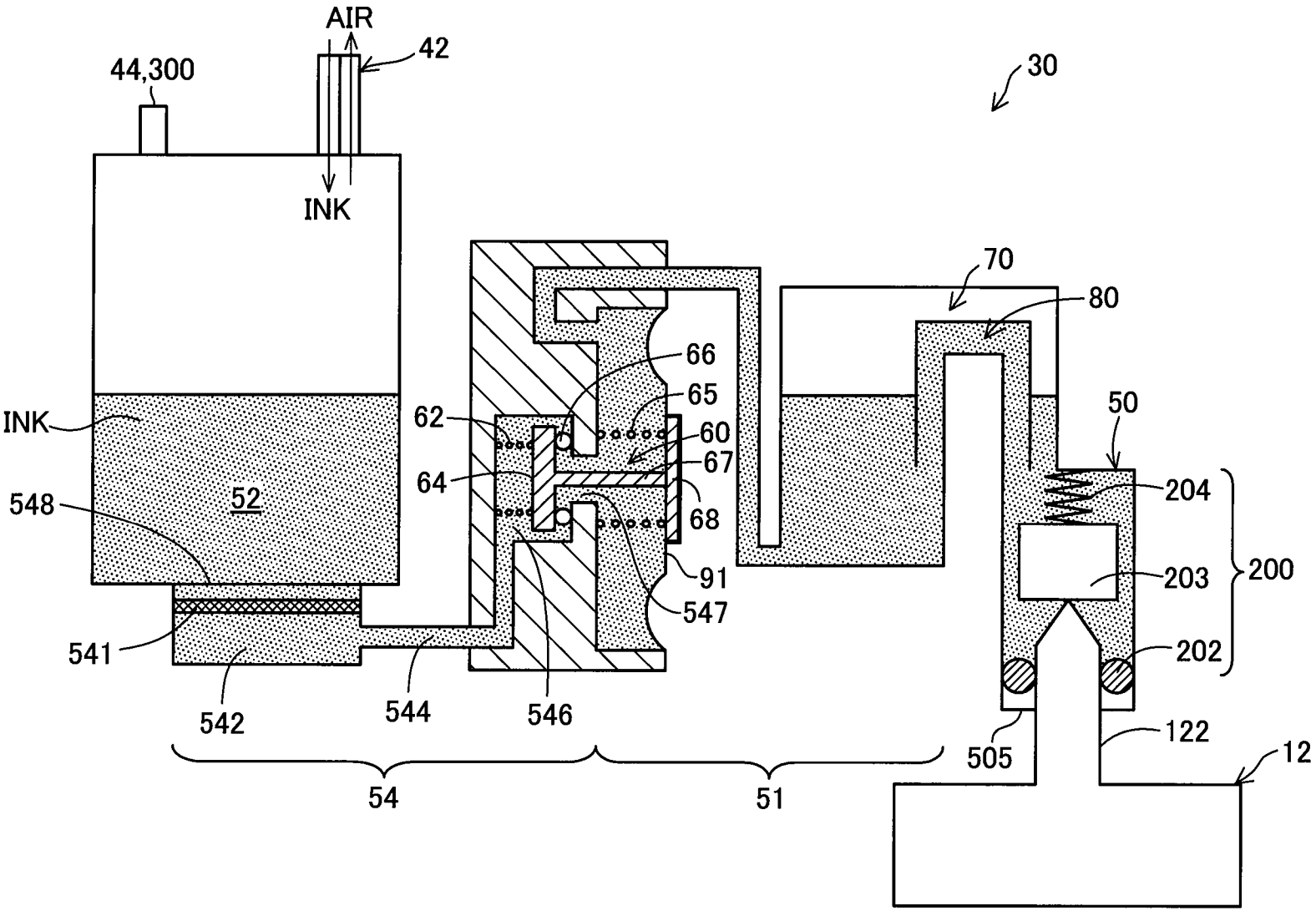
FIG. 3 is a conceptual view for mainly illustrating the configuration of flow paths in the liquid tank.

A-2. Schematic Description of Liquid Tank:

FIG. 3 is a conceptual view for mainly illustrating the configuration of flow paths in the liquid tank 30. Before the description of the detailed configuration of the liquid tank 30, the liquid tank 30 will be schematically described with reference to FIG. 3. A direction in which the liquid flows from the liquid tank 30 toward the liquid ejection head 12 is used as reference for an "upstream side" and a "downstream side" used in the following description. In FIG. 3, regions where the liquid is present are marked with dots.

The liquid tank 30 includes, sequentially from the upstream side as flow paths along which the liquid flows, a second liquid chamber 52, a connection flow path 54, a first liquid chamber 51, a liquid communication flow path 80 and a liquid supply portion 50. The liquid tank 30 also includes an air communication flow path 70 as a flow path along which air flows.

The liquid is able to be filled through a liquid filling portion 42 from the outside into the second liquid chamber 52. The second liquid chamber communicates with the atmosphere through an atmosphere communication portion 300 which includes an atmosphere opening portion 44 serving as one end. The second liquid chamber 52 is able to store the liquid which is supplied to the first liquid chamber 51.

The connection flow path 54 connects the first liquid chamber 51 and the second liquid chamber 52 together so as to be able to supply the liquid in the second liquid chamber 52 to the first liquid chamber 51. The connection flow path 54 includes, sequentially from the upstream side, a filter chamber 542, an intermediate flow path 544 and a valve arrangement chamber 546. The filter chamber 542 is connected to the second liquid chamber 52. Specifically, the filter chamber 542 includes an inflow opening 548 which is opened within the second liquid chamber 52. In other words, the inflow opening 548 is connected to the second liquid chamber 52. The filter chamber 542 includes a filter member 541 which partitions the filter chamber 542 into an upstream side and a downstream side. The filter member 541 captures foreign substances which are delivered from the upstream side to the downstream side so as to suppress the circulation of the foreign substances to the downstream side. In this way, it is possible to reduce the possibility that the foreign substances flow into the liquid ejection head 12, and thus it is possible to suppress the clogging of the liquid ejection head 12 and the occurrence of a failure in the ejecting of the liquid. The filter chamber 542 is arranged on the upstream side with respect to the valve arrangement chamber 546, and thus it is possible to reduce the possibility that the foreign substances flow into the valve arrangement chamber 546. In this way, it is possible to reduce the possibility that due to the foreign substances, a failure occurs in an operation of opening and closing a valve mechanism which will be described later. The filter member 541 is a filter which is formed of stainless steel in a plate shape and which has a plurality of pores that are able to pass the liquid and suppress the passage of the foreign substances. As long as the filter member 541 is able to pass the liquid and suppress the passage of the foreign substances, the filter member 541 may be formed with another member.

The intermediate flow path 544 is a flow path which makes the filter chamber 542 and the valve arrangement chamber 546 communicate with each other. The valve arrangement chamber 546 includes an inlet opening portion 547 which is connected to the first liquid chamber 51. In other words, the inlet opening portion 547 forms one end (downstream end) of the connection flow path 54. The inlet opening portion 547 forms a through hole in which the cross section of the flow path is circular. In the valve arrangement chamber 546, part of a valve mechanism 60 is arranged which opens and closes the inlet opening portion 547 so as to control the flow of the liquid from the second liquid chamber 52 into the first liquid chamber 51. The valve mechanism 60 is brought into an opened state so as to make the second liquid chamber 52 and the first liquid chamber 51 communicate with each other, and thus the liquid in the second liquid chamber 52 flows into the first liquid chamber 51. The valve mechanism 60 is brought into a closed state so as to bring the second liquid chamber 52 and the first liquid chamber 51 into a non-communication state.

The valve mechanism 60 includes a valve member 64, a rod 67, a pressure receiving plate 68, a first biasing member 62 and a second biasing member 65. The valve member 64 is a disk-shaped member and is arranged within the valve arrangement chamber 546. The valve member 64 opposes the inlet opening portion 547 through an annular seal member 66. The seal member 66 is arranged in a circumferential edge portion of the inlet opening portion 547 so as to surround the inlet opening portion 547. The valve member 64 is brought into contact with the seal member 66 so as to bring the valve arrangement chamber 546 and the first liquid chamber 51 into a non-communication state. The valve member 64 is separated from the seal member 66 so as to bring the valve arrangement chamber 546 and the first liquid chamber 51 into a communication state. The rod 67 is a rod-shaped member in which one end is connected to the valve member 64 and in which the other end is connected to the pressure receiving plate 68. The rod 67 is inserted through the inlet opening portion 547. The pressure receiving plate 68 is a disk-shaped member. The pressure receiving plate 68 is brought, by the biasing force of the first biasing member 62 and the second biasing member 65, into contact with a first film 91 which partitions the first liquid chamber 51 and which has flexibility.

The first biasing member 62 is a compression coil spring which is arranged within the valve arrangement chamber 546. The first biasing member 62 biases the valve member 64 toward the side of the seal member 66. The second biasing member 65 is a compression coil spring which is arranged within the first liquid chamber 51. The second biasing member 65 biases the pressure receiving plate 68 toward the side of the first film 91. When the liquid within the first liquid chamber 51 is supplied to the liquid ejection head 12 and consumed by the liquid ejection head 12, and thus the interior of the first liquid chamber 51 has a negative pressure, the pressure receiving plate 68, the rod 67 and the valve member 64 are biased by the first film 91, against the biasing force of the first biasing member 62 and the second biasing member 65, in a direction in which they are separated from the seal member 66 and the inlet opening portion 547. In this way, the valve member 64 is separated from the seal member 66 so as to bring the valve mechanism 60 into the opened state, and thus the valve arrangement chamber 546 and the first liquid chamber 51 are brought into the communication state. When, in the communication state, the liquid is supplied from the second liquid chamber 52 to the first liquid chamber 51, and thus when the pressure within the first liquid chamber 51 is increased to a certain extent (for example, when the pressure is increased beyond a negative pressure), the valve member 64 is moved by the biasing force of the first biasing member 62 and the second biasing member 65 to the side of the seal member 66 so as to make contact with the seal member 66. In this way, the valve mechanism 60 is brought into the closed state, and thus the valve arrangement chamber 546 and the first liquid chamber 51 are brought into the non-communication state. Since as described above, the valve mechanism 60 is brought into the opened state at least when the interior of the first liquid chamber 51 has a negative pressure, it is possible to stabilize the pressure within the first liquid chamber 51. In other words, as compared with a case where a valve mechanism is used that is brought into the opened state when a pressure difference between the upstream side and the downstream side of the valve member 64 exceeds a predetermined value, it is possible to suppress a variation in the pressure within the first liquid chamber 51 corresponding to a difference (water head difference) between the position of the height of the nozzle holes in the liquid ejection head 12 and the position of the height of the liquid surface in the second liquid chamber 52. In this way, it is possible to stably supply the liquid from the second liquid chamber 52 to the first liquid chamber 51.

The first liquid chamber 51 is able to store the liquid which is supplied to the liquid supply portion 50. The liquid communication flow path 80 connects the first liquid chamber 51 and the liquid supply portion 50 together so as to be able to supply the liquid in the first liquid chamber 51 to the liquid supply portion 50. The air communication flow path 70 connects the first liquid chamber 51 and the liquid supply portion 50 together so as to allow air communication between the first liquid chamber 51 and the liquid supply portion 50.

The liquid supply portion 50 includes a liquid supply port 505 at the downstream end. The liquid supply port 505 receives the liquid introduction needle portion 122. The liquid supply portion 50 is removably connected to the liquid introduction needle portion 122 of the liquid ejection head 12. Specifically, the liquid introduction needle portion 122 is inserted through the liquid supply port 505 of the liquid supply portion 50 into the liquid supply portion 50, and thus the liquid supply portion 50 is connected to the liquid introduction needle portion 122. In this way, it is possible to supply the liquid from the liquid supply portion 50 to the liquid introduction needle portion 122.

Within the liquid supply portion 50, a supply portion valve mechanism 200 is arranged which opens and closes a flow path in the liquid supply portion 50. The supply portion valve mechanism 200 includes, sequentially from the downstream side, a valve seat 202, a valve member 203 and a spring 204.

The valve seat 202 is a substantially annular member. The valve seat 202 is formed with an elastic member such as rubber or elastomer. The valve seat 202 is press-fitted into the liquid supply portion 50. The valve member 203 is a substantially cylindrical member. The valve member 203 blocks a hole (valve hole) formed in the valve seat 202 in a state (state before the mounting) before the liquid tank 30 is mounted to the carriage 19. The spring 204 is a compression coil spring. The spring 204 biases the valve member 203 in a direction toward the side of the valve seat 202. In a mounting state of the liquid tank 30 where the liquid tank 30 is mounted to the carriage 19 and where the liquid supply portion 50 is connected to the liquid introduction needle portion 122, the liquid introduction needle portion 122 pushes the valve member 203 to the upstream side, and thus the valve member 203 is moved in a direction away from the valve seat 202. In this way, the supply portion valve mechanism 200 is brought into the opened state so as to be able to supply the liquid from the liquid supply portion 50 to the liquid introduction needle portion 122.

Figure 4:
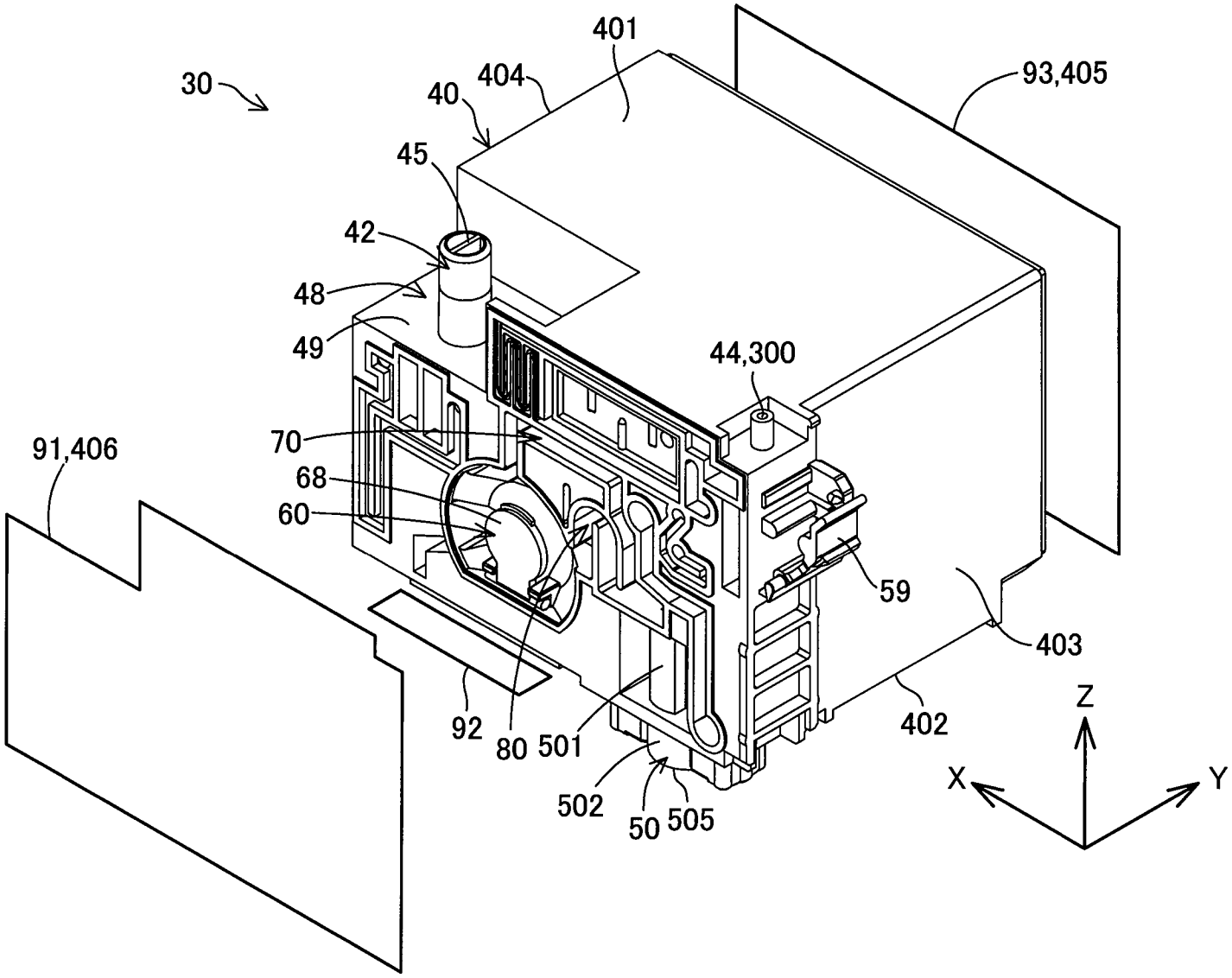
FIG. 4 is a partially exploded perspective view of the liquid tank.
Figure 5:
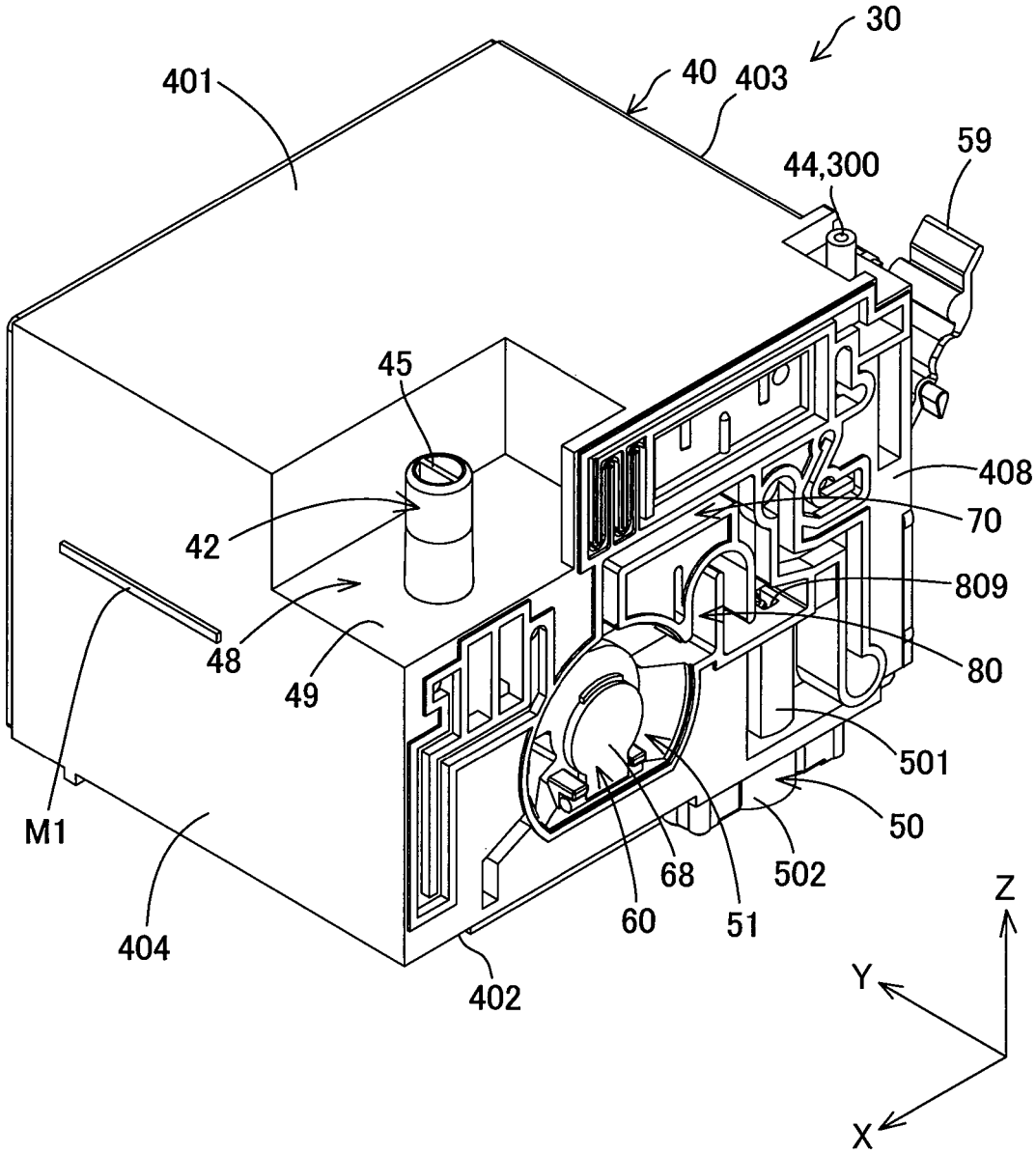
FIG. 5 is a first perspective view of a tank main body.
Figure 6:
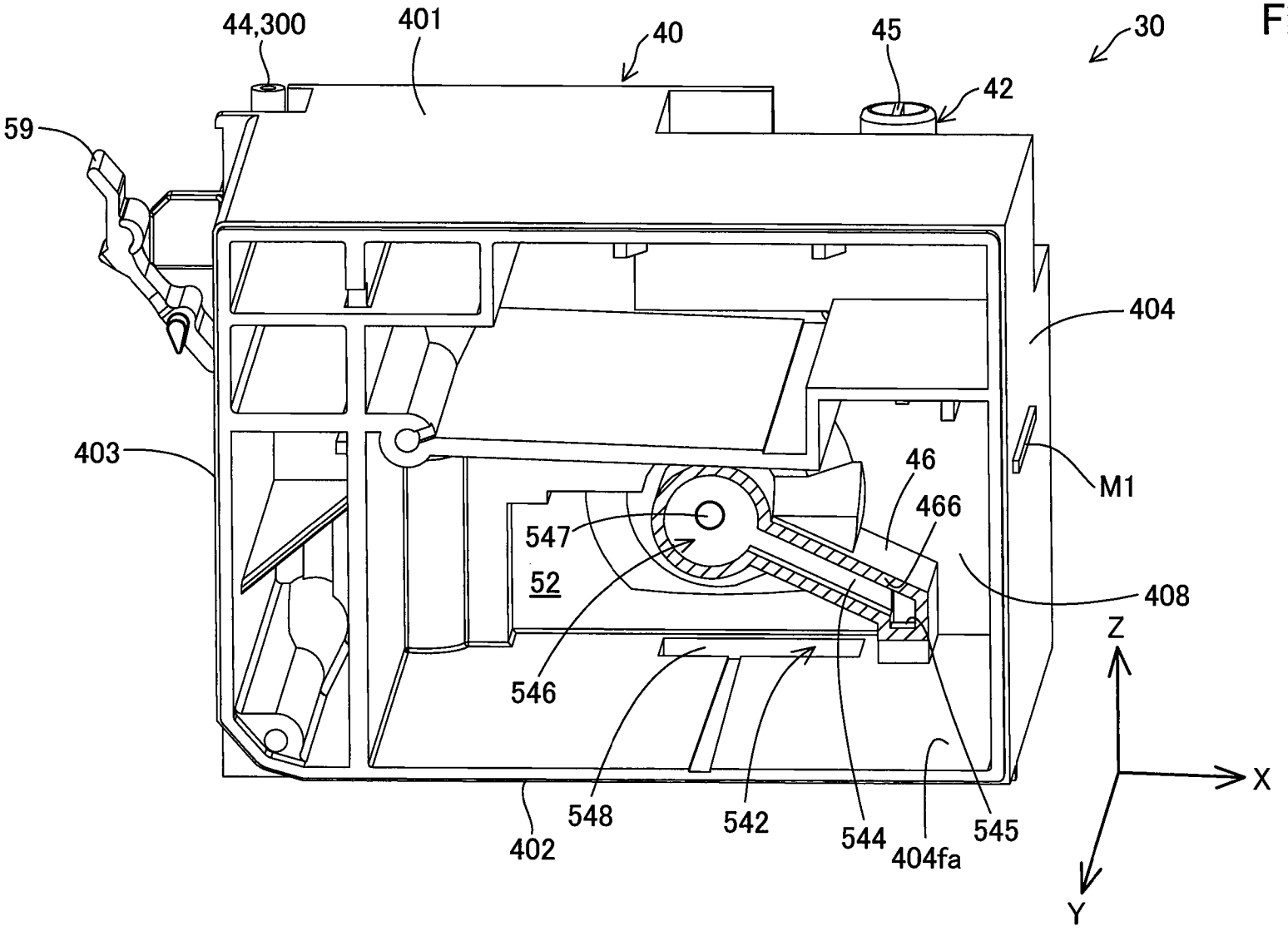
FIG. 6 is a second perspective view of the tank main body.
Figure 7:
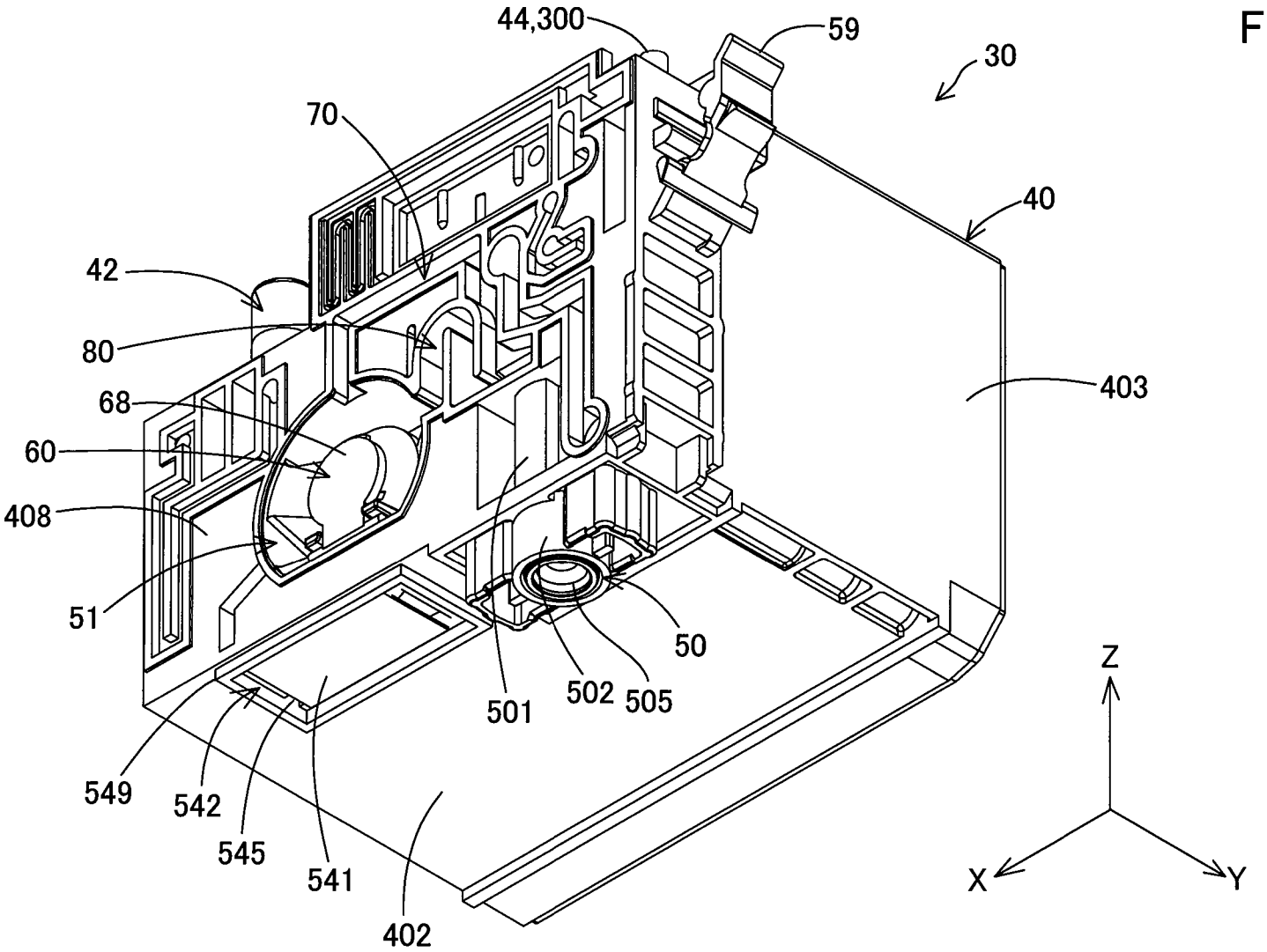
FIG. 7 is a third perspective view of the tank main body.
Figure 8:
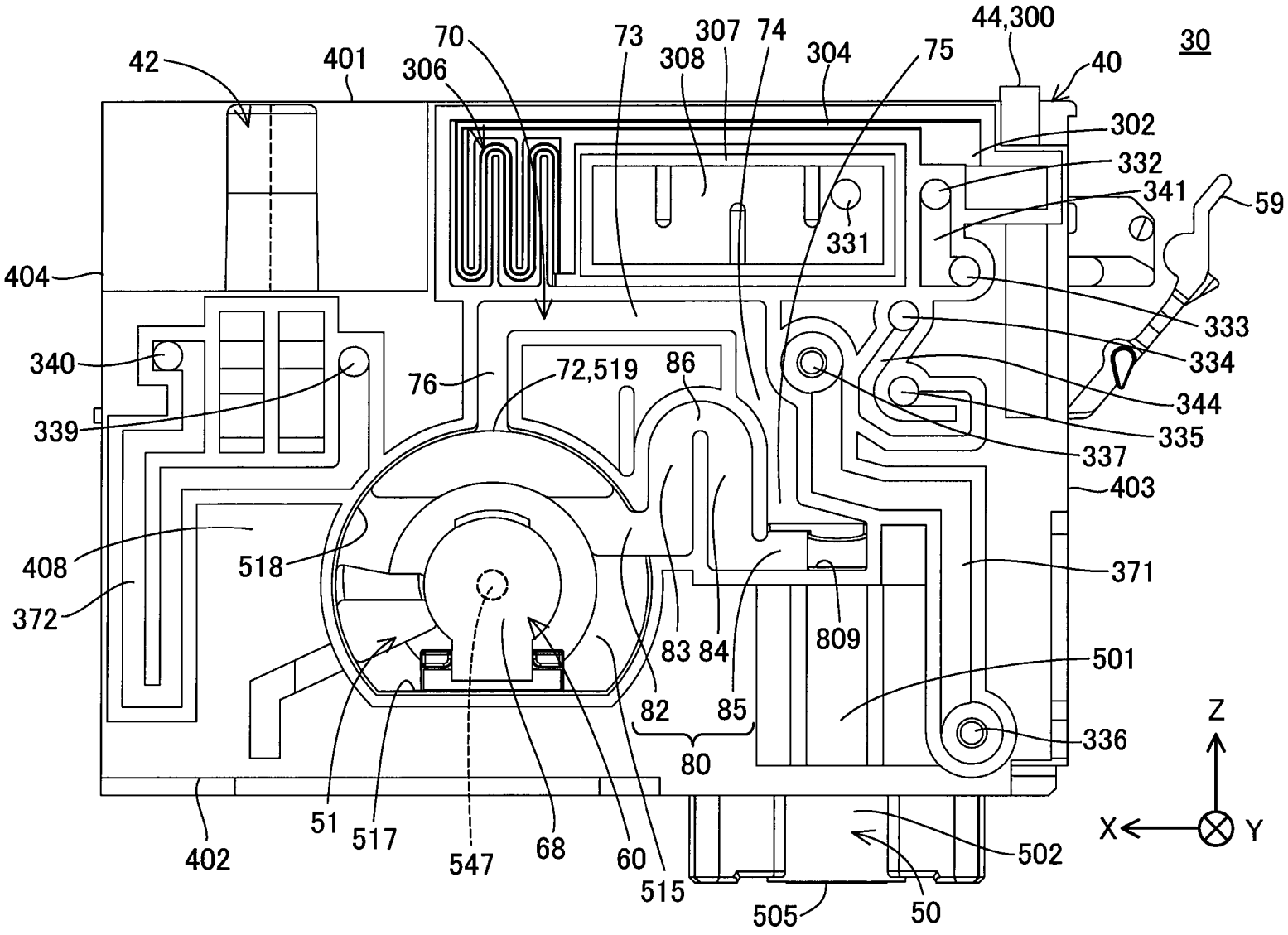
FIG. 8 is a first diagram of the tank main body seen from a minus side of a Y axis direction.
Figure 9:
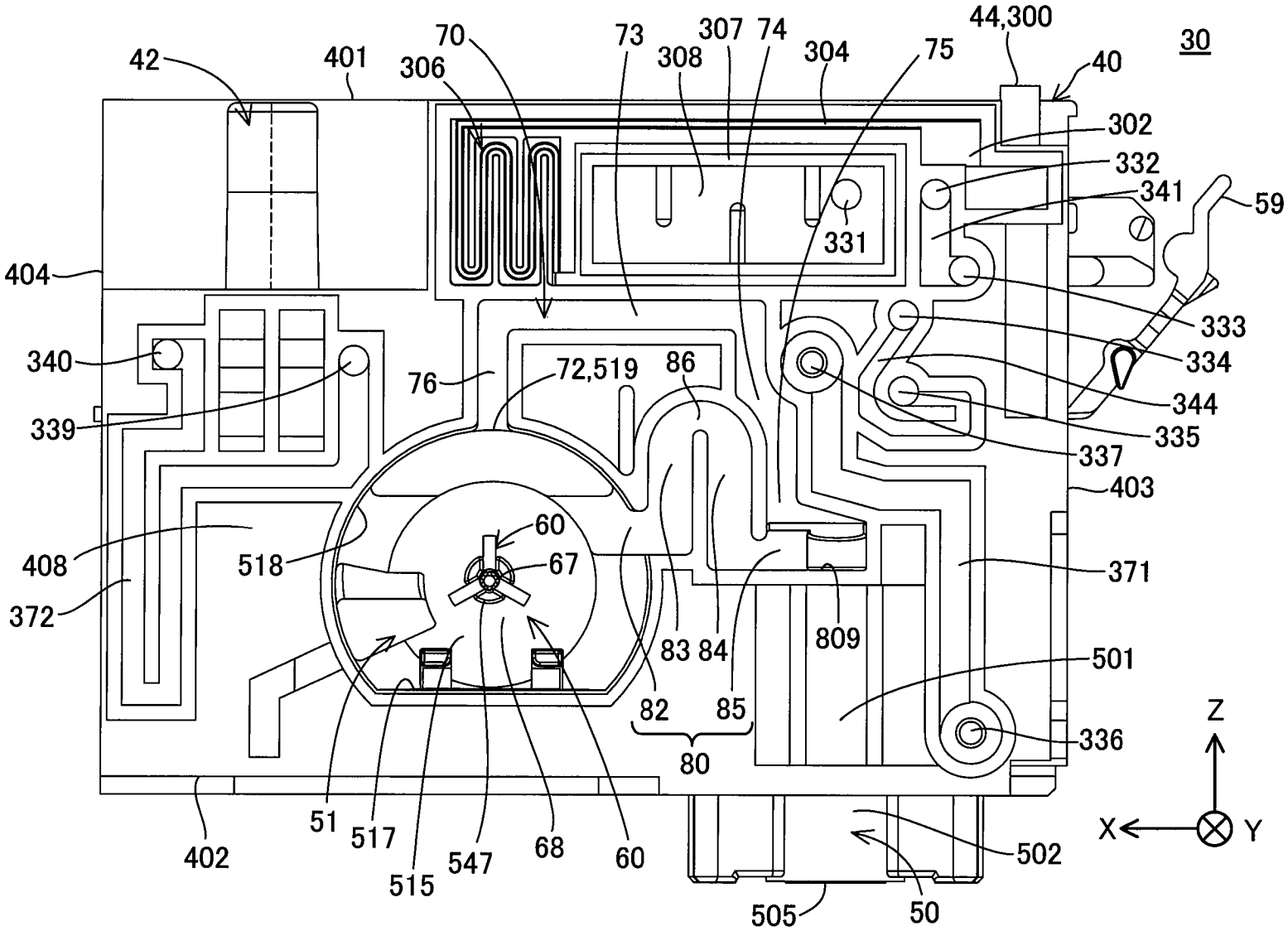
FIG. 9 is a second diagram of the tank main body seen from the minus side of the Y axis direction.
Figure 10A:
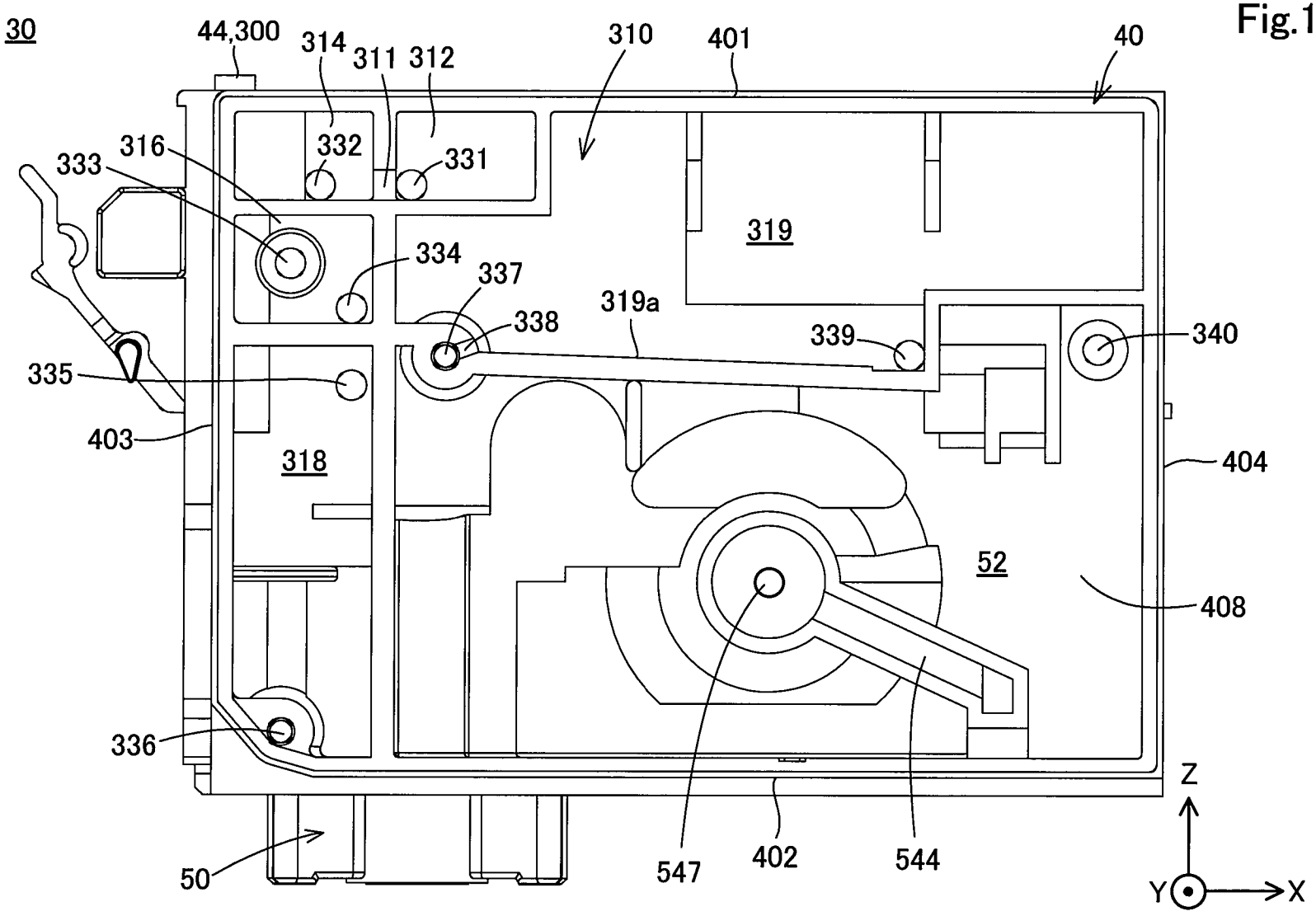
FIG. 10A is a diagram of the tank main body seen from a plus side of the Y axis direction.
Figure 10B:
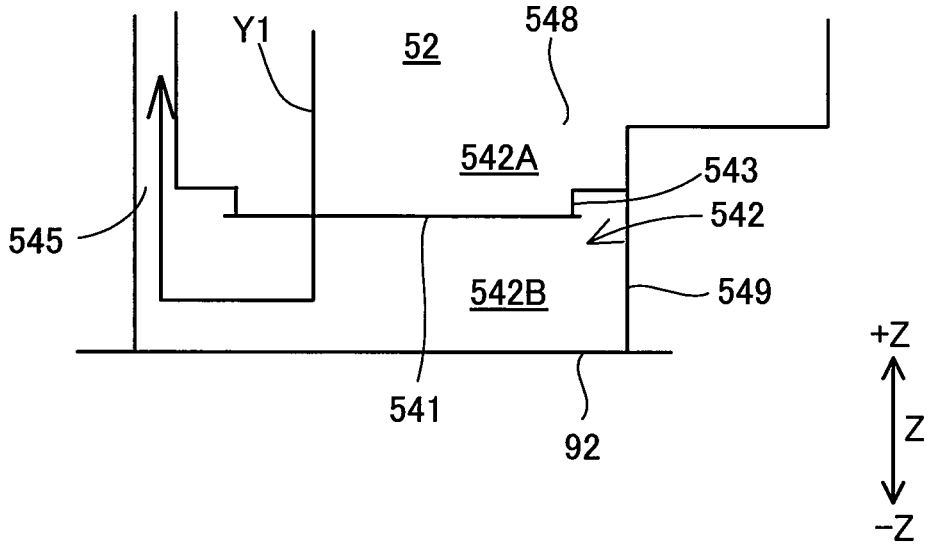
FIG. 10B is a schematic view of a filter chamber.

A-3. Detailed Configuration of Liquid Tank 30:

FIG. 4 is a partially exploded perspective view of the liquid tank 30. FIG. 5 is a first perspective view of a tank main body 40. FIG. 6 is a second perspective view of the tank main body 40. FIG. 7 is a third perspective view of the tank main body 40. FIG. 8 is a first diagram of the tank main body 40 seen from the minus side of the Y axis direction. FIG. 9 is a second diagram of the tank main body 40 seen from the minus side of the Y axis direction. FIG. 10A is a diagram of the tank main body 40 seen from the plus side of the Y axis direction. FIG. 10B is a schematic view of the filter chamber 542. In FIGS. 5, 6, 7 and 8, the valve mechanism 60 arranged in the tank main body 40 is also shown. In FIG. 9, the rod 67 in the valve mechanism 60 is also shown.

As shown in FIG. 4, the liquid tank 30 includes the tank main body 40, the first film 91, a second film 92 and a third film 93. The liquid tank 30 is formed substantially in the shape of a cuboid. In the liquid tank 30, the X axis direction is a length direction, the Y axis direction is a width direction and the Z axis direction is a height direction.

The liquid tank 30 includes an upper surface (a first surface, a first wall) 401, a lower surface (a second surface, a second wall) 402, a back surface (a third surface, a third wall) 403, the front surface (a fourth surface, a fourth wall) 404, a left side surface (a fifth surface, a fifth wall) 405 and a right side surface (a sixth surface, a sixth wall) 406. In the mounting state where the liquid tank 30 is mounted to the carriage 19, the upper surface 401 and the lower surface 402 are opposite each other in the Z axis direction. In the mounting state, the back surface 403 and the front surface 404 are opposite each other in the X axis direction. In the mounting state, the left side surface 405 and the right side surface 406 are opposite each other in the Y axis direction. The left side surface 405 is formed with the third film 93. The right side surface 406 is formed with the first film 91. The upper surface 401, the lower surface 402, the back surface 403 and the front surface 404 are formed with the tank main body 40. The back surface 403, the front surface 404, the left side surface 405 and the right side surface 406 each are surfaces which are substantially vertical with respect to the installation plane of the liquid ejection apparatus 1. The upper surface 401 and the lower surface 402 each are surfaces which are substantially horizontal with respect to the installation plane of the liquid ejection apparatus 1. The individual surfaces 401 to 406 do not need to be completely flat surfaces, and may allow projections and recesses and the like so as to be approximately "vertical" or "horizontal" in appearance. The front surface 404 forms a visual recognition surface through which it is possible to visually recognize the water level of the liquid within the liquid tank 30 (specifically, the second liquid chamber 52) from the outside. For example, the front surface 404 is formed with a transparent or translucent member. In the front surface 404, a mark (for example, a scale or a marking) corresponding to a standard (for example, an upper limit or a lower limit) for the water level (liquid surface) of the liquid may be provided. In the present embodiment, as shown in FIG. 5, the mark M1 corresponding to the upper limit is provided on the front surface 404. For example, when the liquid is filled from the liquid filling portion 42, if the liquid surface reaches the mark M1 corresponding to the upper limit, the user stops the fillion of the liquid. For example, when a mark (lower limit mark) corresponding to the lower limit is provided, if the liquid surface in the liquid tank 30 (specifically, the second liquid chamber 52) reaches the lower limit mark, the user fills the liquid from the liquid filling portion 42 into the second liquid chamber 52.

On the back surface 403, a lever 59 is provided which fits and removes the liquid tank 30 to and from the mounting portion 11 (FIG. 2) of the carriage 19. In the mounting state, the lever 59 engages with the mounting portion 11, and thus the removal of the liquid tank 30 from the mounting portion 11 is suppressed. The mounting portion 11 is able to be elastically deformed. The user presses the lever 59 to the side of the back surface 403, and thus the lever 59 is elastically deformed to the side of the back surface 403, with the result that the engagement with the mounting portion 11 is released. By the release of the engagement, the liquid tank 30 is able to be removed from the mounting portion 11.

The tank main body 40 is formed substantially in the shape of a cuboid, and is formed of a synthetic resin such as polypropylene or polystyrene. The first film 91, the second film 92 and the third film 93 are hermetically adhered to different portions of the tank main body 40, respectively, so as to partition and form, together with the tank main body 40, the flow paths along which the liquid and air are supplied within the liquid tank 30 and the like.

The tank main body 40 (FIG. 6) is formed in a concave shape in which the plus side of the Y axis direction is opened. The tank main body 40 includes one side wall 408 which forms a bottom portion of the tank main body 40 in the concave shape. The side wall 408 is a wall which partitions the first liquid chamber 51 and the second liquid chamber 52.

The side wall 408 is substantially parallel to the X axis direction and the Z axis direction. As shown in FIG. 5, on one side (the minus side of the Y axis direction) of the side wall 408, the first liquid chamber 51, the liquid communication flow path 80 and the air communication flow path 70 are formed. As shown in FIG. 6, the second liquid chamber 52 is formed on the other side (the plus side of the Y axis direction) opposite to the one side of the side wall 408. In this way, the space of the liquid tank 30 is efficiently utilized such that it is possible to arrange the first liquid chamber 51, the liquid communication flow path 80, the air communication flow path 70 and the second liquid chamber 52, with the result that it is possible to suppress an increase in the size of the liquid tank 30.

As shown in FIGS. 4 and 8, in the side wall 408, groove portions are formed so as to partition and form the air communication flow path 70 and the liquid communication flow path 80, and concave portions are formed so as to form the first liquid chamber 51. The first film 91 is hermetically adhered to the end surface of the side wall 408 on the minus side of the Y axis direction, and thus the first liquid chamber 51, the air communication flow path 70 and the liquid communication flow path 80 are partitioned and formed. As shown in FIGS. 4 and 6, the third film 93 is hermetically adhered to the end surface of the tank main body 40 on the plus side of the Y axis direction opposite the side wall 408, and thus the second liquid chamber 52 is partitioned and formed.

The tank main body 40 (FIG. 4) further includes the liquid filling portion 42. The liquid filling portion 42 extends to the plus side of the Z axis direction from the bottom surface 49 of a corner portion 48 where the upper surface 401, the back surface 404 and the left side surface 406 intersect each other. The liquid filling portion 42 is a tube-shaped member and forms a first flow path and a second flow path. A partition wall 45 is arranged within the liquid filling portion 42. The liquid filling portion 42 is partitioned by the partition wall 45 into the first flow path and the second flow path. When the liquid is filled, the first flow path functions as a liquid fillion path for making the liquid flow into the second liquid chamber 52, and the second flow path functions as an air emission path for emitting the air from the second liquid chamber 52. When the liquid in the liquid tank 30 is used, a cap (not shown) is fitted to the liquid filling portion 42. In an upper portion of the tank main body 40, the atmosphere opening portion 44 is formed which is one end portion of the atmosphere communication portion 300. The atmosphere communication portion 300 includes a thin groove-shaped flow path and a buffer chamber which is able to store the ink at the time of backflow of the ink. The other end portion of the atmosphere communication portion 300 is connected to the second liquid chamber 52. In this way, when the liquid tank 30 is used, the second liquid chamber 52 communicates with the atmosphere. The details of the atmosphere communication portion 300 will be described later.

As shown in FIG. 6, the second liquid chamber 52 includes a second liquid chamber bottom surface 404*fa* which forms a bottom surface in the mounting state. The second liquid chamber bottom surface 404*fa* is the inner surface of the lower surface 402. In the second liquid chamber bottom surface 404*fa*, the inflow opening 548 is formed which penetrates along the vertically downward direction (the minus Z axis direction) in the mounting state. The inflow opening 548 is the upstream end of the filter chamber 542 formed in the lower surface 402.

The filter chamber 542 (FIG. 7) is partitioned and formed by a frame-shaped member 549 which protrudes from the lower surface 402 and the second film 92 (FIG. 4) which is hermetically adhered to the lower end surface of the frame-shaped member 549. In the mounting state, the filter chamber 542 is located lower (further in the minus Z axis direction) than the second liquid chamber 52. The filter member 541 is arranged inside the frame-shaped member 549. In the present embodiment, for example, the filter member 541 is arranged in a frame-shaped arrangement portion 543 (FIG. 10B) formed inside the frame-shaped member 549. The filter member 541 is formed in the shape of a plate, and is orthogonal to the vertically downward direction (the minus Z axis direction) in the mounting state. In the peripheral portion of the filter member 541, a communication opening 545 is formed which communicates with the intermediate flow path 544 (FIGS. 7 and 10B). The liquid in the second liquid chamber 52 flows along the minus Z axis direction as indicated by an arrow Y1 so as to pass through the inflow opening 548 and filter member 541, and the liquid which has passed through the filter member 541 flows along the plus Z axis direction so as to pass through the communication opening 545. The liquid which has passed through the communication opening 545 flows into the intermediate flow path 544. As described above, the filter member 541 (FIG. 10B) partitions, in the mounting state, the filter chamber 542 into a first portion 542A which is located in an upper side including the inflow opening 548 and a second portion 542B which is located in a lower side with respect to the first portion 542A. In the mounting state, the filter member 541 is located lower than the inflow opening 548. In this way, even when bubbles are adhered to the filter member 541, the adhered bubbles are able to be guided through the inflow opening 548 to the second liquid chamber 52, with the result that it is possible to reduce the possibility that the bubbles flow out to the first liquid chamber 51 and the liquid supply portion 50.

The intermediate flow path 544 and the valve arrangement chamber 546 (FIG. 6) are formed within the second liquid chamber 52. The intermediate flow path 544 and the valve arrangement chamber 546 are partitioned and formed by the side wall 408, a flow path wall 46 which rises from the side wall 408 toward the side of the opening of the concave-shaped tank main body 40 (the plus side of the Y axis direction) and a film (not shown) which is hermetically adhered to the end surface 466 of the flow path wall 46 on the plus side of the Y axis direction. The end surface 466 to which the film is adhered is single-hatched.

In the mounting state, the intermediate flow path 544 extends in a direction which includes a horizontal direction component and a vertically upward direction component. In the other embodiment, the intermediate flow path 544 may be formed so as to extend vertically upward. The valve arrangement chamber 546 is formed substantially in the shape of a circle when the tank main body 40 is seen from the plus side of the Y axis direction. The inlet opening portion 547 is formed in the valve arrangement chamber 546. Specifically, the inlet opening portion 547 is a through hole which penetrates the side wall 408.

The first liquid chamber 51 (FIG. 8) is formed in the side wall 408, and is formed by a concave portion having the side in the horizontal direction (in the present embodiment, the minus Y axis direction) opened and the first film 91 (FIG. 4) hermetically adhered to the end surface of the concave portion on the minus side of the Y axis direction. The volume (the maximum volume) of the first liquid chamber 51 is smaller than that of the second liquid chamber 52 (the maximum volume). The first liquid chamber 51 includes a side wall 515 which opposes the first film 91, a bottom wall 517 which is located on the side of the vertically downward direction in the mounting state and an arc-shaped circumferential wall 518 which extends, in the mounting state, from the bottom wall 517 toward the vertically upward direction. The inlet opening portion 547 is formed in the side wall 515. The circumferential wall 518 includes a portion which opposes the bottom wall 517. In the mounting state, the circumferential wall 518 includes an uppermost portion 519 which is arranged in the highest position within the first liquid chamber 51.

The liquid communication flow path 80 (FIG. 8) forms, in the mounting state, a flow path which is upwardly convex. In the present embodiment, the liquid communication flow path 80 forms, in the mounting state, a flow path in the shape of an inverted letter U. The liquid communication flow path 80 includes, sequentially from the upstream side in the direction of flow of the liquid, an upstream end 82, a rising flow path 83, a liquid intermediate flow path 86, a lowering flow path 84 and a downstream end 85.

The upstream end 82 is an opening which is formed in the circumferential wall 518 of the first liquid chamber 51, and is connected to the first liquid chamber 51. The rising flow path 83 is located on the downstream side of the upstream end 82 and extends upward in the direction of the flow in the mounting state. In the present embodiment, the rising flow path 83 extends from the upstream end 82 toward the vertically upward direction. In the other embodiment, as long as the rising flow path 83 includes an upward component, the rising flow path 83 may extend obliquely. Here, in the mounting state, the inlet opening portion 547 is arranged in a position lower than the upstream end 82. In other words, the inlet opening portion 547 is arranged in a position closer to the bottom wall 517 than the upstream end 82.

Here, since the liquid contains pigment particles, it is likely that the liquid makes contact with gas and receives a pressure variation caused by the opening and closing of the valve mechanism 60 and that the pigment particles are thus agglomerated so as to become foreign substances. As described above, in the mounting state, the inlet opening portion 547 is arranged in the position lower than the upstream end 82, and thus it is possible to suppress the lowering of the water level of the liquid beyond the inlet opening portion 547. Hence, it is possible to reduce the presence of gas around the inlet opening portion 547, and thus it is possible to reduce the possibility that foreign substances appear around the inlet opening portion 547. In this way, it is possible to reduce the possibility that foreign substances flow into the liquid ejection head 12.

The liquid intermediate flow path 86 connects the rising flow path 83 and the lowering flow path 84 together. In the mounting state, the liquid intermediate flow path 86 is located in the highest portion of the liquid communication flow path 80. In other words, in the mounting state, the liquid intermediate flow path 86 is a portion which is higher than the upstream end 82 and the downstream end 85 forming both ends of the liquid communication flow path 80. The liquid intermediate flow path 86 is a flow path which changes the flow of the liquid from the upward direction to the downward direction and which is bent 180 degrees. In the mounting state, the liquid intermediate flow path 86 is arranged in a position lower than the highest portion (air second flow path 73) of the air communication flow path 70 which will be described later.

In the direction of the flow, the lowering flow path 84 is located on the downstream side with respect to the rising flow path 83 and the liquid intermediate flow path 86, and extends downward in the mounting state. In the present embodiment, the lowering flow path 84 extends from the liquid intermediate flow path 86 in the vertically downward direction. In the other embodiment, as long as the lowering flow path 84 includes a downward component, the lowering flow path 84 may extend obliquely.

In the direction of the flow, the downstream end 85 is located on the downstream side with respect to the lowering flow path 84 and is connected to the liquid supply portion 50. The downstream end 85 is formed as a connection chamber that connects together the lowering flow path 84 and a liquid inlet 809 serving as the upstream end of the liquid supply portion 50 which will be described later. This connection chamber also serves as a second connection end 75 of the air communication flow path 70 which will be described later.

The air communication flow path 70 (FIG. 8) includes a first connection end (air side connection portion) 72 which forms one end, an air first flow path 76, an air second flow path 73, an air third flow path 74 and a second connection end (supply side connection portion) 75 which forms the other end. In the mounting state, the air communication flow path 70 is connected to the first liquid chamber 51 in a position higher than the upstream end 82 that is a position of connection of the liquid communication flow path 80 and the first liquid chamber 51. Since the upper end portion of the liquid intermediate flow path 86 is arranged in a position higher than the uppermost portion 519 of the first liquid chamber 51, the liquid tank 30 is able to store the liquid up to around the uppermost portion 519 of the first liquid chamber 51.

The first connection end 72 is an opening which is formed in the uppermost portion 519 of the circumferential wall 518. In other words, in the mounting state, the air communication flow path 70 is connected to the uppermost portion 519 of the first liquid chamber 51. In the mounting state, the air first flow path 76 extends upward from the first connection end 72. The air second flow path 73 connects together the air first flow path 76 and the air third flow path 74, and extends in the horizontal direction (in the present embodiment, the X axis direction) in the mounting state. In the mounting state, the air third flow path 74 extends downward from the air second flow path 73. The air third flow path 74 is connected to the liquid supply portion 50 through the second connection end 75. The second connection end 75 is formed as a connection chamber which connects together the air third flow path 74 and the liquid inlet 809.

In the mounting state, the liquid supply portion 50 (FIG. 7) is located lower than the downstream end 85. In the mounting state, the liquid supply portion 50 extends downward toward the liquid supply port 505. Although in the present embodiment, in the mounting state, the liquid supply portion 50 extends in the vertically downward direction toward the liquid supply port 505, in the other embodiment, as long as the liquid supply portion 50 includes a downward component, the liquid supply portion 50 may extend obliquely.

The liquid supply portion 50 (FIG. 8) includes a liquid inlet 809, a first supply portion 501 and a second supply portion 502. In the direction of flow of the liquid, the liquid inlet 809 forms the upstream end of the liquid supply portion 50. In the mounting state, the liquid inlet 809 is opened toward the vertically downward direction. The first supply portion 501 forms therewithin a flow path which is connected to the liquid inlet 809. The first supply portion 501 is formed within the tank main body 40. The second supply portion 502 is connected to the first supply portion 501. In the mounting state, the second supply portion 502 is formed with a member which protrudes vertically downward from the lower surface 402. The second supply portion 502 includes the liquid supply port 505. The liquid supply port 505 is opened toward the vertically downward direction in the mounting state.

As shown in FIG. 8, when the liquid tank 30 is seen from one side (the minus side of the Y axis direction) of the side wall 408, the liquid filling portion 42 and the liquid supply port 505 are arranged in diagonal positions. For example, when the liquid tank 30 is seen from one side (the minus side of the Y axis direction) of the side wall 408, the liquid filling portion 42 is located, in the mounting state, on the vertically upward side with respect to the first liquid chamber 51 and on one side (for example, the plus side of the X axis direction) in the horizontal direction (for example, the X axis direction) with respect to the first liquid chamber 51 whereas the liquid supply port 505 is located, in the mounting state, on the vertically downward side with respect to the first liquid chamber 51 and on the other side (for example, the minus side of the X axis direction) in the horizontal direction (for example, the X axis direction) with respect to the first liquid chamber 51. In this way, since it is possible to suppress the shortening of a distance from the liquid filling portion 42 to the liquid supply port 505, even if bubbles appear when the liquid is filled from the liquid filling portion 42 into the second liquid chamber 52, it is possible to reduce the possibility that the bubbles reach the liquid supply port 505. In this way, it is possible to reduce the bubbles retained in the vicinity of the liquid supply port 505 within the liquid supply portion 50, and thus it is possible to reduce the possibility that the bubbles flow into the liquid ejection head 12. Since it is possible to efficiently arrange the flow paths along which the liquid is supplied from the liquid filling portion 42 to the liquid supply port 505, it is possible to suppress an increase in the size of the liquid tank 30.

The atmosphere communication portion 300 will next be described with reference to FIGS. 9 and 10A. A direction in which a fluid (air) flows from the outside toward the second liquid chamber 52 is used as the reference for an "upstream side" and a "downstream side" used in the description of the atmosphere communication portion 300.

The atmosphere communication portion 300 includes, sequentially from the upstream side, the atmosphere opening portion 44 which serves as the upstream end, a first atmosphere flow path 302 (FIG. 9), a second atmosphere flow path 304 (FIG. 9), a meandering flow path 306 (FIG. 9), a gas-liquid separation chamber 308 (FIG. 9), a buffer chamber 310 (FIG. 10A), an atmosphere intermediate flow path 372 (FIG. 9) and an atmosphere introduction portion 340 which serves as the downstream end. Here, various types of flow paths which are formed on one side (the minus side of the Y axis direction) of the side wall 408 in the atmosphere communication portion 300 are partitioned by the tank main body 40 and the first film 91 (FIG. 4), and various types of flow paths which are formed on the other side (the plus side of the Y axis direction) of the side wall 408 are partitioned by the tank main body 40 and the third film 93 (FIG. 4). The buffer chamber 310 includes, sequentially from the upstream side, a first buffer chamber 312, a second buffer chamber 314, a third buffer chamber 316, a fourth buffer chamber 318 and a fifth buffer chamber 319.

The atmosphere opening portion 44 (FIG. 9) is a tube-shaped member which extends from a portion of the upper surface 401 on the side of the back surface 403 in the plus Z axis direction. The first atmosphere flow path 302 (FIG. 9) is a flow path which connects together the atmosphere opening portion 44 and the second atmosphere flow path 304. The second atmosphere flow path 304 is an elongated flow path which extends along the X axis direction. The meandering flow path 306 connects together the second atmosphere flow path 304 and the gas-liquid separation chamber 308. The meandering flow path 306 is the flow path which is elongated and meanders in order to increase the flow path length of the atmosphere communication portion 300. In this way, it is possible to suppress the evaporation of water in the liquid in the second liquid chamber 52. A gas-liquid separation membrane (not shown) is arranged in the inner circumferential wall 307 of the gas-liquid separation chamber 308. The gas-liquid separation membrane is formed of a material which allows the permeation of gas and which does not allow the permeation of liquid. The downstream end of the gas-liquid separation chamber 308 is a through hole 331 which penetrates the side wall 408. The gas-liquid separation chamber 308 and the first buffer chamber 312 (FIG. 10A) are connected together by the through hole 331. The first buffer chamber 312 communicates with the second buffer chamber 314 through a gap 311 between the third film 93 and the end surface of the tank main body 40 on the plus side of the Y axis direction.

The second buffer chamber 314 and a first intermediate connection flow path 341 (FIG. 8) communicate with each other through a through hole 332 which penetrates the side wall 408. The downstream end of the first intermediate connection flow path 341 is a through hole 333 which penetrates the side wall 408. The first intermediate connection flow path 341 and the third buffer chamber 316 (FIG. 10A) communicate with each other through the through hole 333. The third buffer chamber 316 and a second intermediate connection flow path 344 communicate with each other through a through hole 334 which penetrates the side wall 408. The second intermediate connection flow path 344 and the fourth buffer chamber 318 communicate with each other through a through hole 335 which penetrates the side wall 408. The fourth buffer chamber 318 and a third intermediate connection flow path 371 communicate with each other through a through hole 336 which penetrates the side wall 408. The third intermediate connection flow path 371 and the fifth buffer chamber 319 communicate with each other through a through hole 337 which penetrates the side wall 408 and a notch portion 338 which is formed at the periphery of the through hole 337. The bottom surface 319*a* of the fifth buffer chamber 319 is inclined downward from the notch portion 338 on the upstream side toward a though hole 339 on the downstream side. In this way, even when the liquid enters the fifth buffer chamber 319 from the though hole 339, it is possible to reduce the possibility that the liquid reaches the notch portion 338.

The fifth buffer chamber 319 and the atmosphere intermediate flow path 372 communicate with each other through the though hole 339 which penetrates the side wall 408. The atmosphere intermediate flow path 372 and the second liquid chamber 52 communicate with each other through the atmosphere introduction portion 340 which penetrates the side wall 408. In the mounting state, the atmosphere introduction portion 340 is arranged in the vicinity of the upper surface of the second liquid chamber 52.

Figure 11:
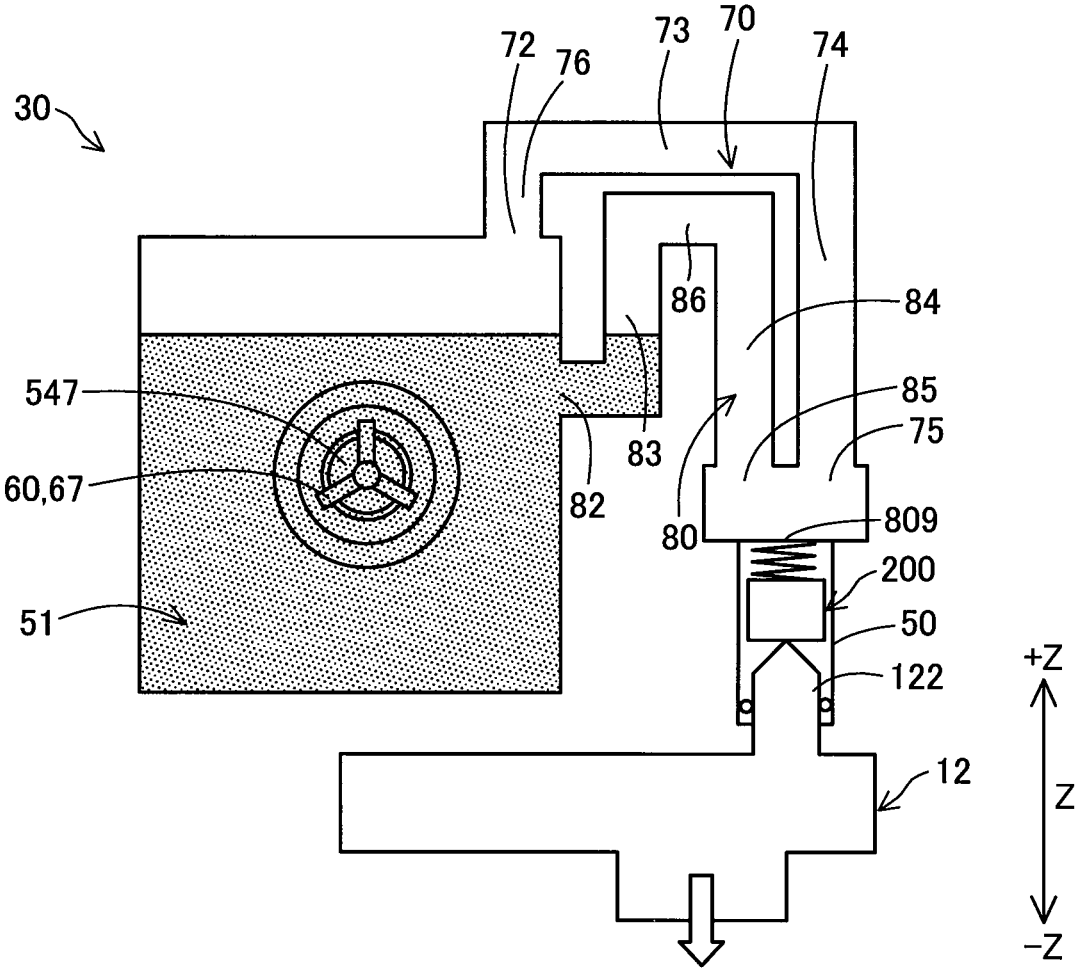
FIG. 11 is a first diagram for illustrating the initial charging of a liquid.
Figure 12:
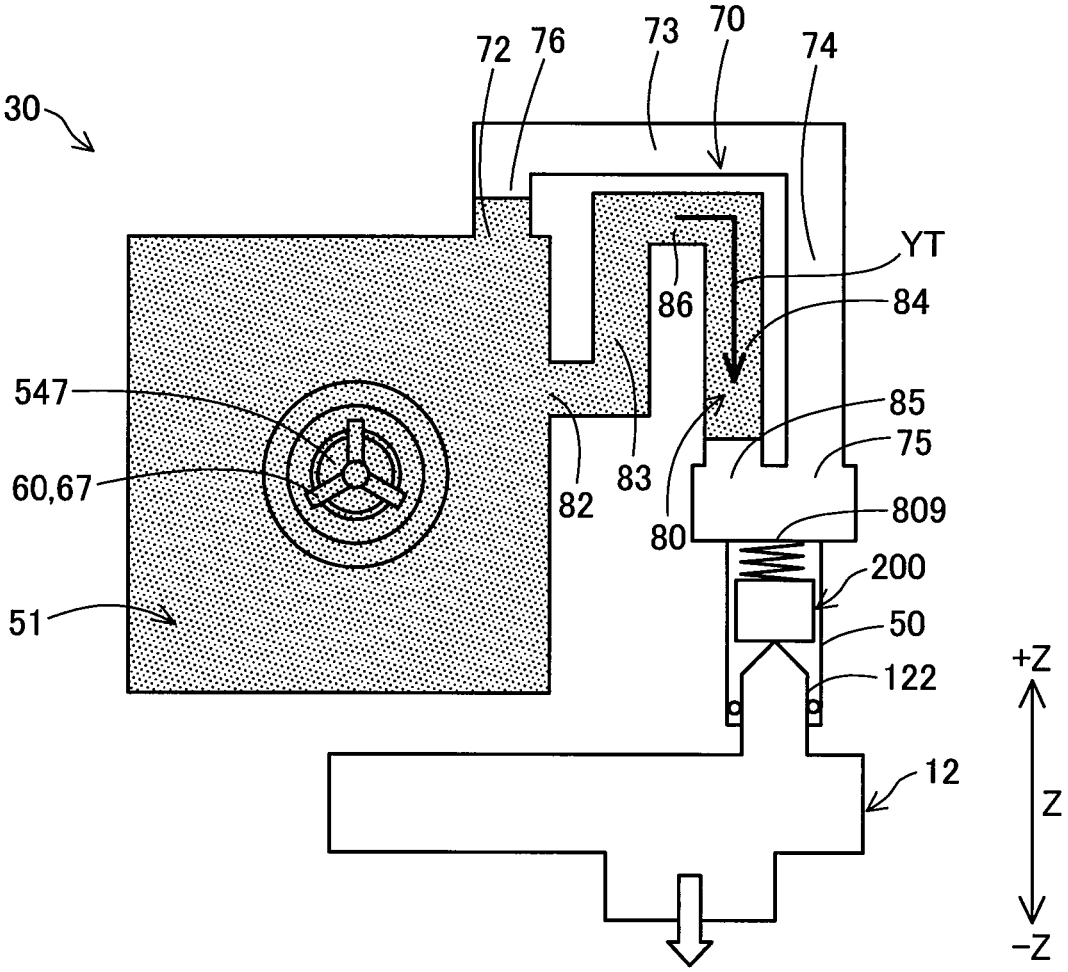
FIG. 12 is a second diagram for illustrating the initial charging of the liquid.
Figure 13:
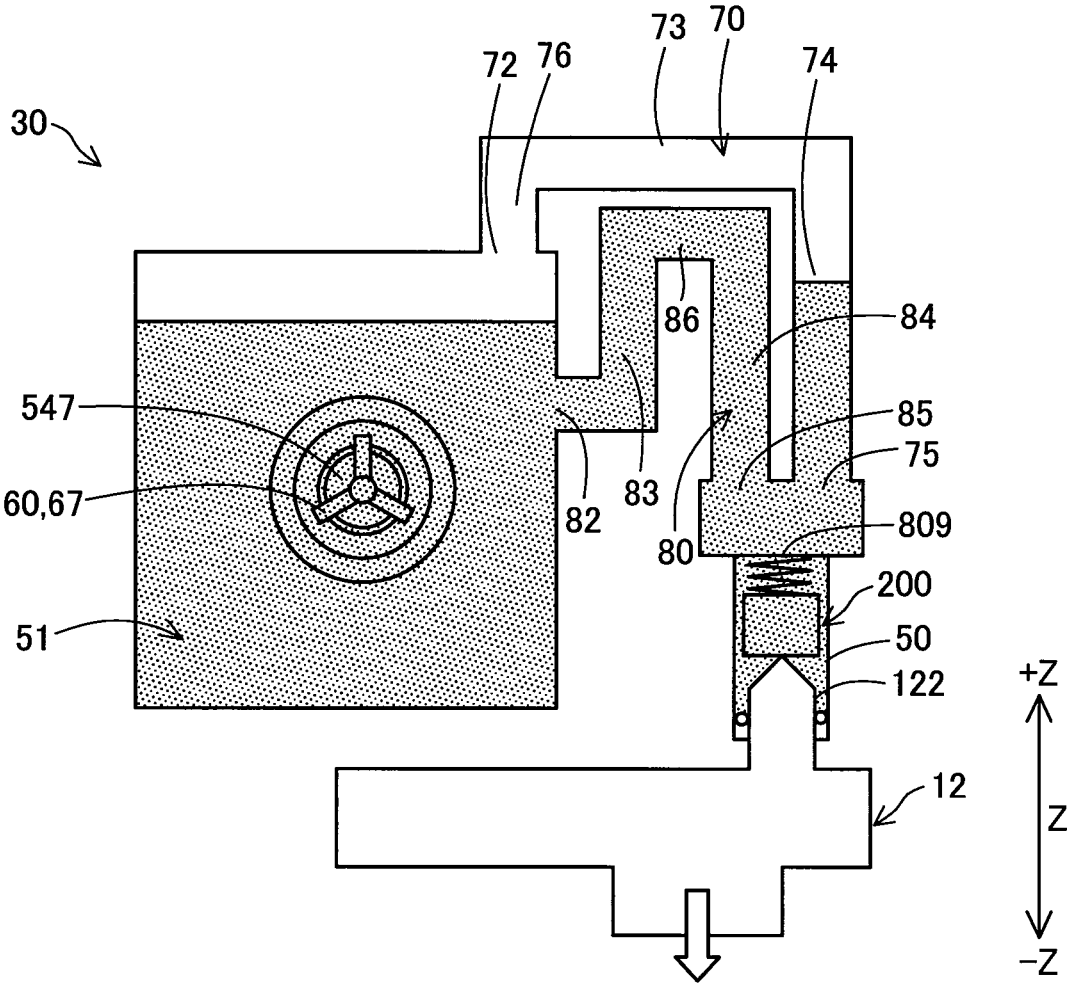
FIG. 13 is a third diagram for illustrating the initial charging of the liquid.

A-4. Initial Charging of Liquid to Liquid Tank 30:

The initial charging of the liquid to the liquid tank 30 will be described with reference to FIGS. 11 to 13. FIG. 11 is a first diagram for illustrating the initial charging of the liquid. FIG. 12 is a second diagram for illustrating the initial charging of the liquid. FIG. 13 is a third diagram for illustrating the initial charging of the liquid. In FIGS. 11 to 13, a region in which the liquid is present is marked with dots.

In the initial charging of the liquid, the liquid is first filled from the liquid filling portion 42 (FIG. 5) into the second liquid chamber 52 (FIG. 6). Then, as indicated by an arrow in FIG. 11, the suction (emission operation) of fluids (for example, the air and the liquid) within the liquid tank 30 from the liquid ejection head 12 through the liquid supply portion 50 starts. This suction is performed by driving the suction pump 16 in the emission portion 18. The interior of the first liquid chamber 51 has a negative pressure as a result of the suction, and thus the valve mechanism 60 is brought into the opened state, whereby the liquid in the second liquid chamber 52 flows through the inlet opening portion 547 into the first liquid chamber 51. Here, the flow of the liquid to the liquid supply portion 50 is blocked by the rising flow path 83 in the liquid communication flow path 80, and thus it is possible to suppress the flow of the liquid from the first liquid chamber 51 into the liquid supply portion 50. On the other hand, as the liquid flows into first liquid chamber 51, the air within the first liquid chamber 51 is emitted through the air communication flow path 70 and the liquid supply portion 50 to the side of the liquid ejection head 12. In this way, the water level in the first liquid chamber 51 is raised.

As shown in FIG. 12, when the water level in the first liquid chamber 51 is raised so as to reach the same height as the uppermost portion of the liquid communication flow path 80, the flow of the liquid into the liquid communication flow path 80 starts, and thus as indicated by an arrow YT, the liquid flows from the liquid communication flow path 80 into the side of the liquid supply portion 50. The flow of the liquid from the liquid communication flow path 80 into the side of the liquid supply portion 50 is rapidly performed by not only the suction from the suction pump 16 but also a siphon phenomenon.

As shown in FIG. 13, when the suction is further continued, the liquid which has flowed into the liquid communication flow path 80 flows through the second connection end 75 into the air communication flow path 70. The liquid which has flowed into the liquid communication flow path 80 also flows into the liquid supply portion 50 and the liquid ejection head 12. The liquid flows into the air communication flow path 70, and thus the air present in the air communication flow path 70 flows into the first liquid chamber 51. The air present in the air communication flow path 70 flows into the first liquid chamber 51, and thus the water level in the first liquid chamber 51 is lowered. However, since the volume of the first liquid chamber 51 is sufficiently larger than the volume of the air communication flow path 70, it is possible to suppress the lowering of the water level in the first liquid chamber 51 which causes the air to reach the upstream end 82. In other words, the upstream end 82 is connected, in the mounting state, to a position lower than a region where the air flowing into the first liquid chamber 51 is located when the air equivalent to the volume of the air communication flow path 70 flows into the first liquid chamber 51 from a state where the first liquid chamber 51 is filled with the liquid. As described above, it is possible to suppress the flow of the air in the first liquid chamber 51 from the upstream end 82 into the liquid communication flow path 80 after the liquid communication flow path 80 is filled with the liquid, and thus it is possible to reduce the possibility that the bubbles flow into the liquid ejection head 12 at the time of the initial charging.

In this way, the initial charging of the liquid to the first liquid chamber 51, the liquid communication flow path 80, the liquid supply portion 50 and the liquid ejection head 12 is completed. After the completion of the initial charging, the suction performed by the suction pump 16 is stopped. The liquid within the first liquid chamber 51 when the initial charging is completed is not present in all regions of the first liquid chamber 51 but the air which is substantially equivalent to the volume of the air communication flow path 70 is present.

Figure 14:
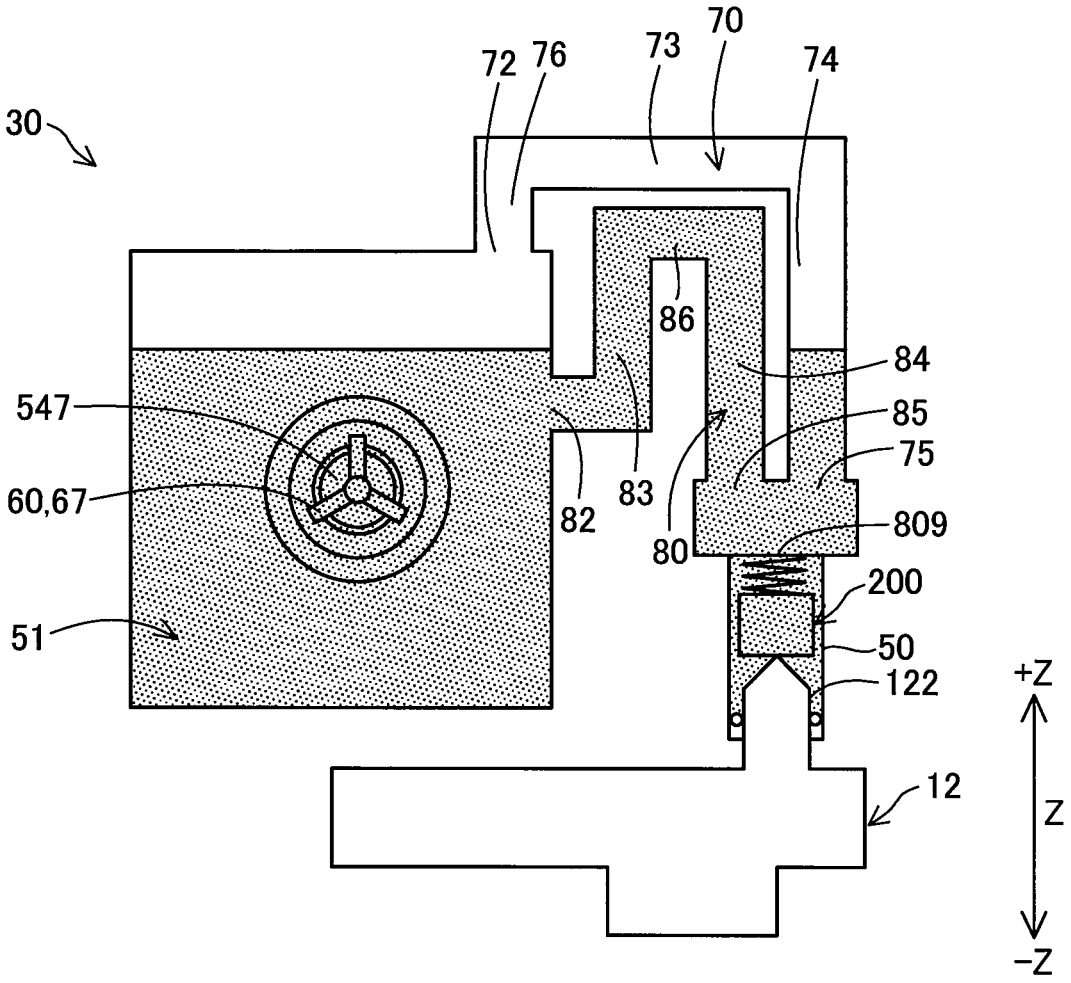
FIG. 14 is a first diagram for illustrating the liquid tank after the initial charging of the liquid.
Figure 15:
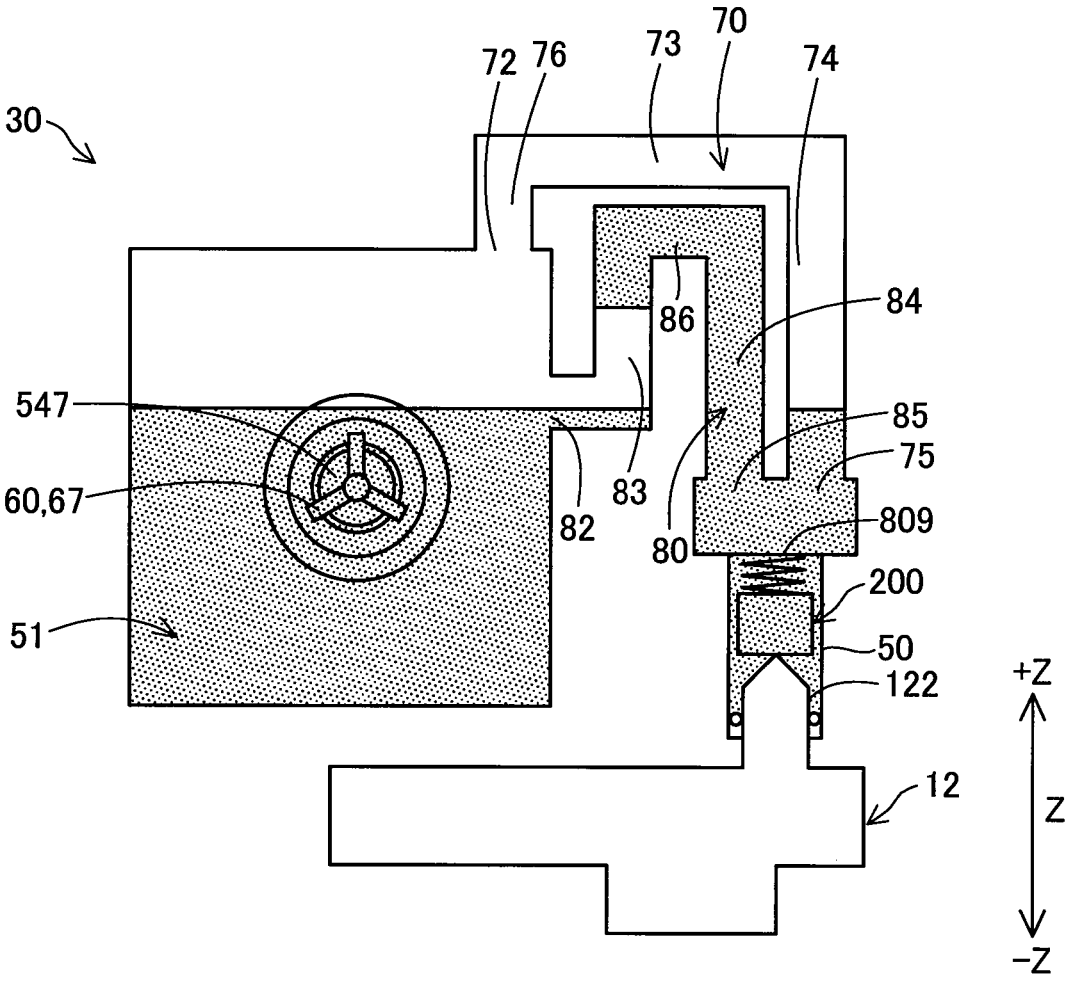
FIG. 15 is a second diagram for illustrating the liquid tank after the initial charging of the liquid.
Figure 16:
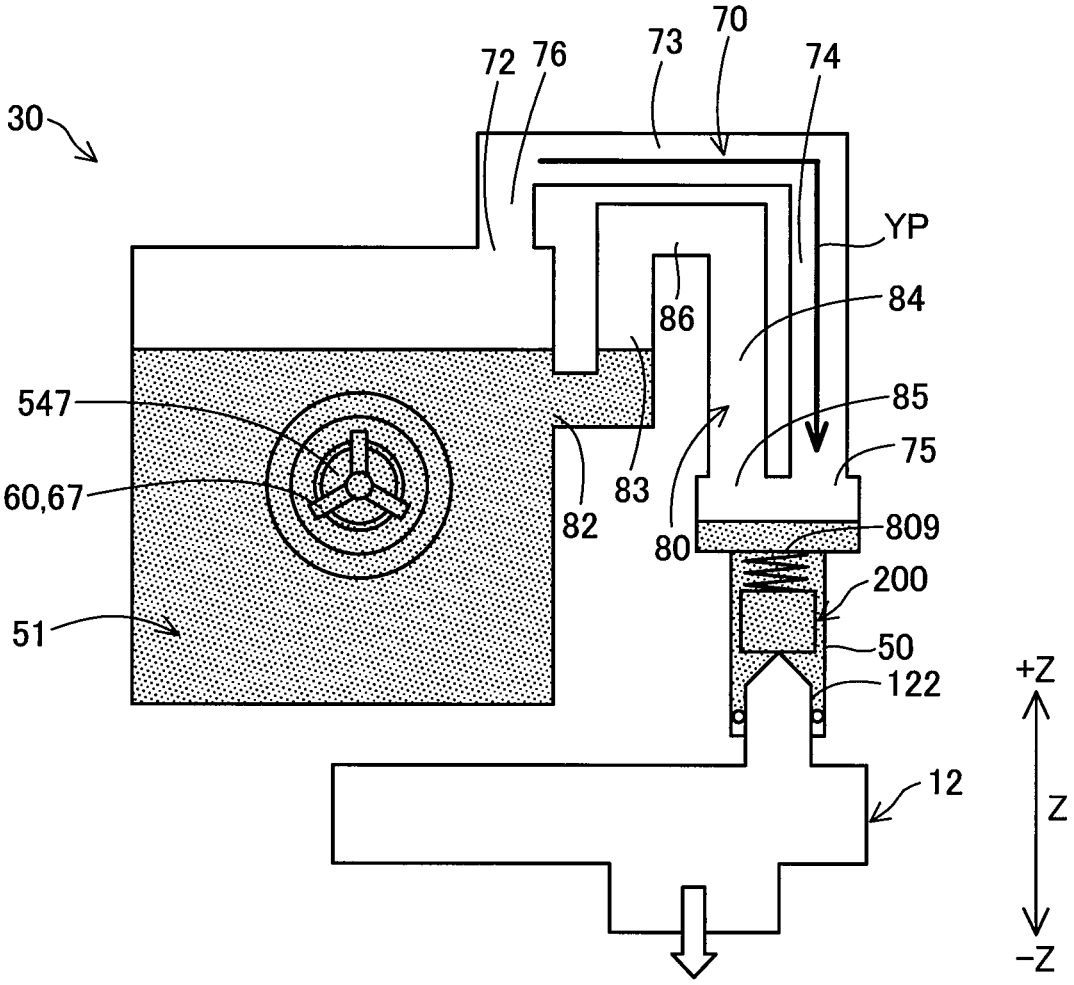
FIG. 16 is a third diagram for illustrating the liquid tank after the initial charging of the liquid.
Figure 17:
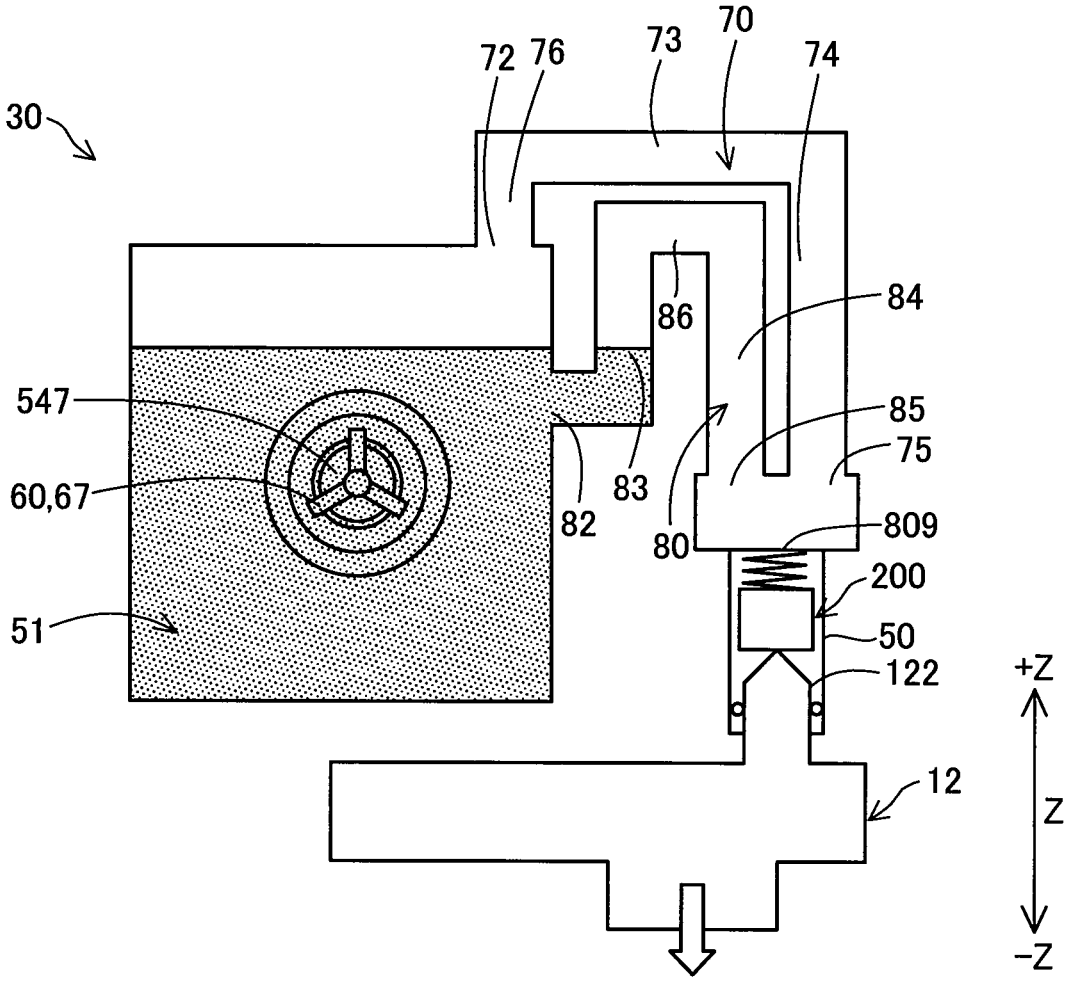
FIG. 17 is a fourth diagram for illustrating the liquid tank after the initial charging of the liquid.
Figure 18:
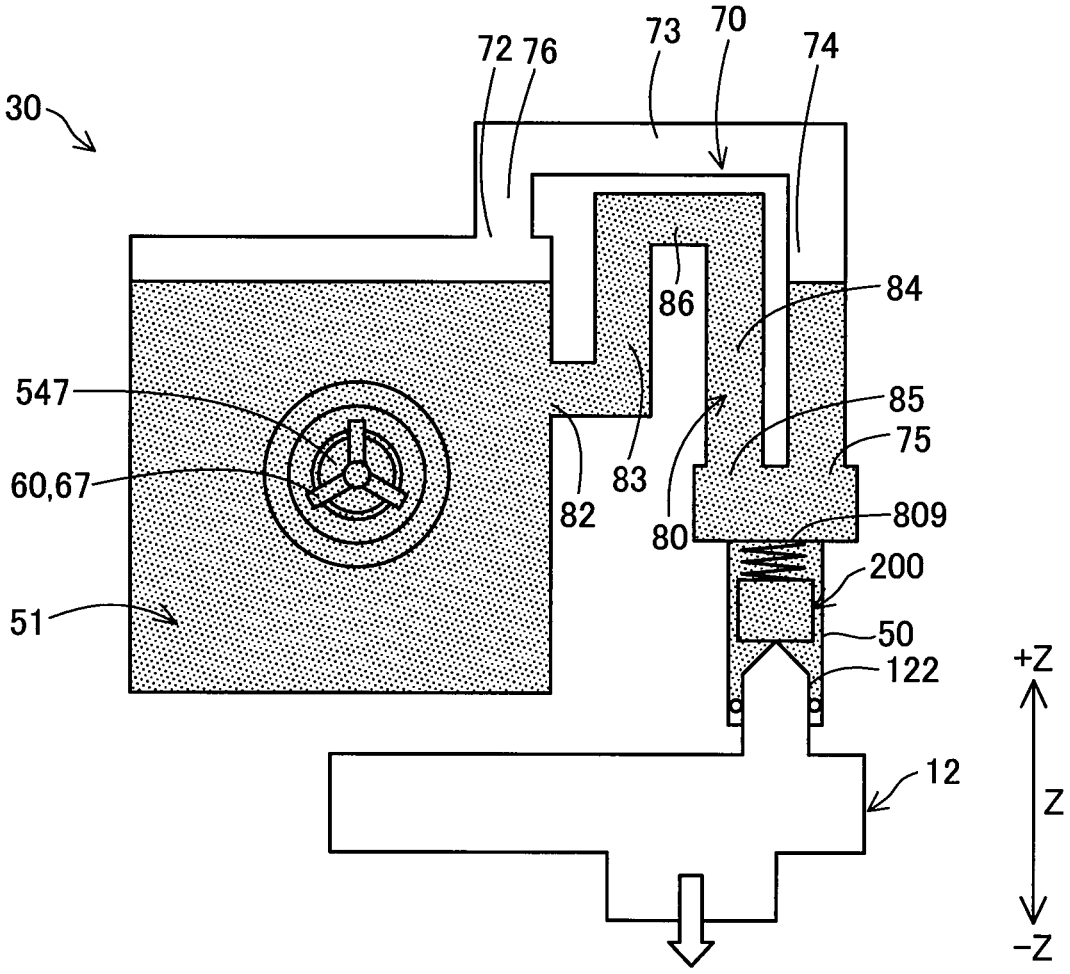
FIG. 18 is a fifth diagram for illustrating the liquid tank after the initial charging of the liquid.

A-5. Liquid Tank 30 after Initial Charging of Liquid:

The liquid tank 30 after the initial charging of the liquid will be described with reference to FIGS. 14 to 18. FIG. 14 is a first diagram for illustrating the liquid tank 30 after the initial charging of the liquid. FIG. 15 is a second diagram for illustrating the liquid tank 30 after the initial charging of the liquid. FIG. 16 is a third diagram for illustrating the liquid tank 30 after the initial charging of the liquid. FIG. 17 is a fourth diagram for illustrating the liquid tank 30 after the initial charging of the liquid. FIG. 18 is a fifth diagram for illustrating the liquid tank 30 after the initial charging of the liquid. In FIGS. 14 to 18, a region in which the liquid is present is marked with dots.

As shown in FIG. 14, in the liquid tank 30 after the initial charging of the liquid, as time passes, air gradually enters the first liquid chamber 51 from the outside by permeating the tank main body 40 and the first film 91 (FIG. 4). In this way, the bubbles in the first liquid chamber 51 grow so as to be increased in size, and thus the water level in the first liquid chamber 51 is lowered. However, when only little time has passed after the initial charging, only a small amount of air flows from the outside into the first liquid chamber 51, and thus the water level in the first liquid chamber 51 is kept in a position higher than the upstream end 82. In this state, it is possible to suppress the flow of the bubbles into the liquid ejection head 12 through the rising flow path 83, and thus it is possible to reduce the occurrence of nozzle omission that is a phenomenon in which the liquid is not ejected from the liquid ejection head 12.

As shown in FIG. 15, when time further passes, and air further enters the first liquid chamber 51 such that the bubbles in the first liquid chamber 51 grow further, the water level in the first liquid chamber 51 is lowered beyond the upper end portion of the upstream end 82. In this case, the upstream end 82 makes contact with the air present in the first liquid chamber 51, and thus the air in the first liquid chamber 51 is able to flow into the liquid communication flow path 80. When the air in the first liquid chamber 51 flows into the liquid communication flow path 80, the liquid (first liquid) within the liquid communication flow path 80 is not continuously connected to the liquid (second liquid) within the second liquid chamber 52, and thus the first liquid and the second liquid are separated from each other by the air.

When, in the state of FIG. 15, the liquid is ejected from the liquid ejection head 12 so as to perform a recording operation (printing operation), the following phenomenon occurs. Specifically, as shown in FIG. 16, as the liquid in the liquid communication flow path 80 is consumed, the air in the first liquid chamber 51 flows through the air communication flow path 70 into the side of the liquid supply portion 50 as indicated by an arrow YP. Furthermore, when the recording operation is performed, as shown in FIG. 17, the liquid within the liquid supply portion 50 is consumed, and thus the air flows into the side of the liquid ejection head 12, with the result that dot omission is able to occur.

When, as shown in FIG. 17, the air flows into the side of the liquid ejection head 12 such that dot omission occurs, the user operates the operation portion 4 (FIG. 1) so as to make the emission portion 18 perform the emission operation. In this way, through the same process (FIGS. 12 and 13) as the initial charging of the liquid, as shown in FIG. 18, the liquid is charged to the liquid communication flow path 80, the liquid supply portion 50 and the liquid ejection head 12. When the amount of liquid in the second liquid chamber 52 is small, the user fills the liquid from the liquid filling portion 42 (FIG. 4) into the second liquid chamber 52. Here, when the recording operation (printing operation) of the liquid ejection head 12 or the emission operation performed by the emission portion 18 causes the liquid to flow to the liquid communication flow path 80, the pressure of the downstream side with respect to the liquid communication flow path 80 is lowered only by an amount corresponding to a pressure loss in the liquid communication flow path 80. However, since the degree of the decrease in pressure is significantly low, the water level in the air communication flow path 70 on the side of the second connection end 75 is hardly lowered. Hence, the possibility that the bubbles flow from the air communication flow path 70 into the liquid supply portion 50 is reduced.

When a sensor for detecting that the air flows from the liquid tank 30 into the liquid ejection head 12 is newly provided in the liquid ejection head 12, and the flow of the air thereinto is detected by the sensor, a notification that the user is prompted to perform the emission operation may be provided by the liquid ejection apparatus 1 to the user. This notification may be performed by newly providing a display portion on the front surface 103 (FIG. 1) and displaying on the display portion a message for prompting the user to perform the emission operation.

According to the first embodiment described above, in the mounting state, the liquid supply portion 50 is located lower than the downstream end 85 and extends downward toward the liquid supply port 505 (FIG. 8). In this way, it is possible to suppress an increase in the size of the liquid tank 30 in the horizontal direction. Hence, it is possible to smoothly supply the liquid from the liquid supply portion 50 to the liquid ejection head 12, and thus it is possible to efficiently supply the liquid to the liquid ejection head 12.

According to the first embodiment described above, when the liquid is charged to the liquid ejection head 12 and the like by the suction from the side of the liquid ejection head 12 into the liquid tank 30, the air which is pushed out by the liquid flowing into the air communication flow path 70 is able to be bypassed through the air communication flow path 70 to the first liquid chamber 51. Hence, it is possible to reduce the possibility that the bubbles flow into the liquid ejection head when the liquid is charged to the liquid ejection head 12. According to the embodiment described above, since the valve mechanism 60 has a negative pressure, as a result of the liquid in the first liquid chamber 51 being sucked from the liquid ejection head 12, so as to be brought into the opened state, when the liquid is filled into the second liquid chamber 52 from the liquid filling portion 42 in which the suction from the liquid ejection head 12 is not performed, the valve mechanism 60 is brought into the closed state. Hence, it is possible to suppress the bubbles in the second liquid chamber 52 from flowing into the first liquid chamber 51, the bubbles appearing when the liquid is filled from the liquid filling portion 42 into the second liquid chamber 52.

According to the first embodiment described above, since the volume of the first liquid chamber 51 is smaller than that of the second liquid chamber 52, when the air in the first liquid chamber 51 is sucked and emitted to the liquid ejection head 12, it is possible to reduce the amount of air sucked. In this way, it is possible to reduce the time in which the air is sucked. According to the embodiment described above, in the mounting state, the air communication flow path 70 is connected to the uppermost portion 519 of the first liquid chamber 51 (FIG. 8). In this way, it is possible to reduce the possibility that the liquid flows into the air communication flow path 70. At the time of the initial charging or the emission operation using the emission portion 18 after the initial charging, it is possible to make the air in the side of the liquid supply portion 50 smoothly flow into the first liquid chamber 51 through the air communication flow path 70.

B. Second Embodiment

A liquid tank 30*a* according to a second embodiment of the present disclosure will be described below. As in the first embodiment, the liquid tank 30*a* is removably fitted to the mounting portion 11 of the liquid ejection apparatus 1. In the following description, the same configurations as in the first embodiment are identified with the same symbols, and the description thereof will be omitted as necessary.

Figure 19:
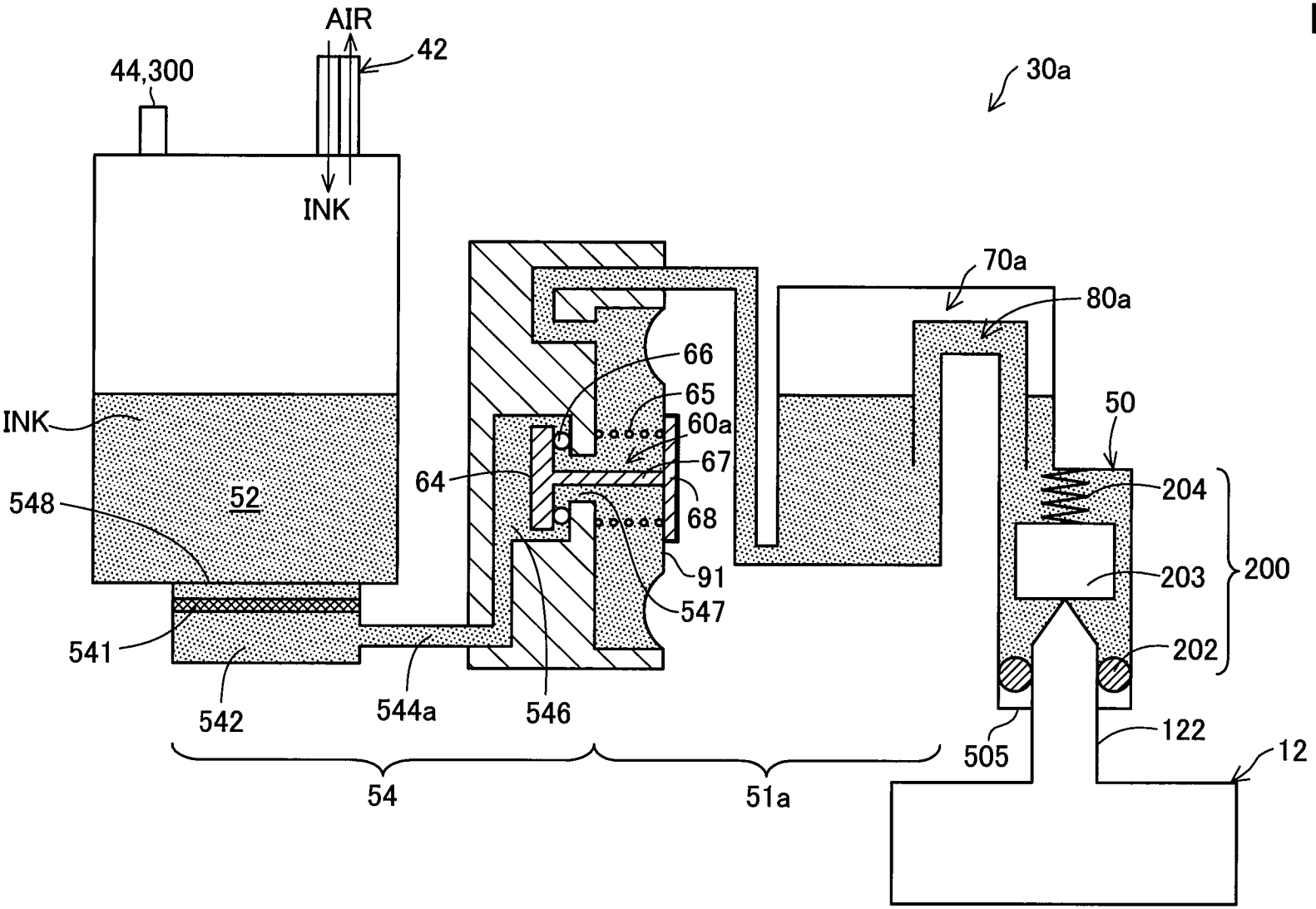
FIG. 19 is a conceptual diagram for mainly illustrating the configuration of flow paths in a liquid tank in a second embodiment.

B-1. Schematic Description of Liquid Tank:

FIG. 19 is a conceptual view for mainly illustrating the configuration of flow paths in the liquid tank 30*a* according to the second embodiment of the present disclosure. Before the description of the detailed configuration of the liquid tank 30*a*, the liquid tank 30*a* will be schematically described with reference to FIG. 19. A direction in which the liquid flows from the liquid tank 30*a* toward the liquid ejection head 12 is used as the reference for an "upstream side" and a "downstream side" used in the following description. In FIG. 19, regions where the liquid is present are marked with dots.

The liquid tank 30*a* includes, sequentially from the upstream side as flow paths along which the liquid flows, the second liquid chamber 52, the connection flow path 54, a first liquid chamber 51*a*, a liquid communication flow path 80*a* and the liquid supply portion 50. The liquid tank 30*a* also includes an air communication flow path 70*a* as a flow path along which air flows.

The liquid is able to be filled through the liquid filling portion 42 from the outside into the second liquid chamber 52. The second liquid chamber communicates with the atmosphere through the atmosphere communication portion 300 which includes the atmosphere opening portion 44 serving as one end. The second liquid chamber 52 communicates with the first liquid chamber 51*a* so as to be able to store the liquid which is supplied to the first liquid chamber 51*a*, that is, the liquid before being stored in the first liquid chamber 51*a*.

The connection flow path 54 connects the first liquid chamber 51*a* and the second liquid chamber 52 together so as to be able to supply the liquid in the second liquid chamber 52 to the first liquid chamber 51*a*. The connection flow path 54 includes, sequentially from the upstream side, the filter chamber 542, an intermediate flow path 544*a* and the valve arrangement chamber 546. The filter chamber 542 is formed so as to be located lower than the second liquid chamber 52 in the mounting state of the liquid tank 30*a*. The filter chamber 542 is connected to the second liquid chamber 52. Specifically, the filter chamber 542 includes the inflow opening 548 which is an opening formed in the bottom surface of the second liquid chamber 52. In other words, the inflow opening 548 is connected to the second liquid chamber 52. In the filter chamber 542, the filter member 541 is arranged which partitions the filter chamber 542 into the upstream side and the downstream side, and the filter chamber 542 is connected through the filter member 541 to the second liquid chamber 52. As in the first embodiment, the filter member 541 captures foreign substances which are delivered from the upstream side to the downstream side so as to suppress the circulation of the foreign substances to the downstream side.

The intermediate flow path 544*a* is a flow path which connects the filter chamber 542 and the first liquid chamber 51*a* together and which makes the filter chamber 542 and the valve arrangement chamber 546 communicate with each other. The valve arrangement chamber 546 includes the inlet opening portion 547 which is connected to the first liquid chamber 51*a*. In other words, the inlet opening portion 547 forms one end (downstream end) of the connection flow path 54. The inlet opening portion 547 forms a through hole in which the cross section of the flow path is circular. In the valve arrangement chamber 546, part of the valve mechanism 60*a* is arranged which opens and closes the inlet opening portion 547 so as to control the flow of the liquid from the second liquid chamber 52 into the first liquid chamber 51*a*. The valve mechanism 60*a* is brought into the opened state so as to make the second liquid chamber 52 and the first liquid chamber 51*a* communicate with each other, and thus the liquid in the second liquid chamber 52 flows into the first liquid chamber 51*a*. The valve mechanism 60*a* is brought into the closed state, and thus the second liquid chamber 52 and the first liquid chamber 51*a* are brought into the non-communication state.

The valve mechanism 60*a* includes the valve member 64, the rod 67, the pressure receiving plate 68 and a biasing member 65. The valve member 64 is a disk-shaped member and is arranged within the valve arrangement chamber 546. The valve member 64 opposes the inlet opening portion 547 through the annular seal member 66. The seal member 66 is arranged in the circumferential edge portion of the inlet opening portion 547 so as to surround the inlet opening portion 547. The valve member 64 is brought into contact with the seal member 66 so as to bring the valve arrangement chamber 546 and the first liquid chamber 51*a* into the non-communication state. The valve member 64 is separated from the seal member 66 so as to bring the valve arrangement chamber 546 and the first liquid chamber 51*a* into the communication state. The rod 67 is a rod-shaped member in which one end is connected to the valve member 64 and in which the other end is connected to the pressure receiving plate 68. The rod 67 is inserted through the inlet opening portion 547. The pressure receiving plate 68 is a disk-shaped member. The pressure receiving plate 68 is brought, by the biasing force of the biasing member 65, into contact with the first film 91 which partitions the first liquid chamber 51*a* and which has flexibility.

The biasing member 65 is a compression coil spring which is arranged within the first liquid chamber 51*a*. The biasing member 65 biases the pressure receiving plate 68 toward the side of the first film 91. When the liquid within the first liquid chamber 51*a* is supplied to the liquid ejection head 12 and consumed by the liquid ejection head 12, and thus the interior of the first liquid chamber 51*a* has a predetermined negative pressure, the pressure receiving plate 68, the rod 67 and the valve member 64 are biased by the first film 91, against the biasing force of the biasing member 65, in a direction in which they are separated from the seal member 66 and the inlet opening portion 547. In this way, the valve member 64 is separated from the seal member 66 so as to bring the valve mechanism 60*a* into the opened state, and thus the valve arrangement chamber 546 and the first liquid chamber 51*a* are brought into the communication state. When, in the communication state, the liquid is supplied from the second liquid chamber 52 to the first liquid chamber 51*a*, and thus when the pressure within the first liquid chamber 51*a* is increased to a certain extent (for example, when the pressure is increased beyond the predetermined negative pressure), the valve member 64 is moved by the biasing force of the biasing member 65 to the side of the seal member 66 so as to make contact with the seal member 66. In this way, the valve mechanism 60*a* is brought into the closed state, and thus the valve arrangement chamber 546 and the first liquid chamber 51*a* are brought into the non-communication state. Since as described above, the valve mechanism 60*a* is brought into the opened state at least when the interior of the first liquid chamber 51*a* has the predetermined negative pressure, it is possible to stabilize the pressure within the first liquid chamber 51*a*.

The first liquid chamber 51*a* is able to store the liquid which is supplied to the liquid supply portion 50. The liquid communication flow path 80*a* connects the first liquid chamber 51*a* and the liquid supply portion 50 together so as to be able to supply the liquid in the first liquid chamber 51*a* to the liquid supply portion 50. The air communication flow path 70*a* connects the first liquid chamber 51*a* and the liquid supply portion 50 together so as to allow air communication between the first liquid chamber 51*a* and the liquid supply portion 50.

B-2. Detailed Configuration of Liquid Tank 30*a:*

Figure 20:
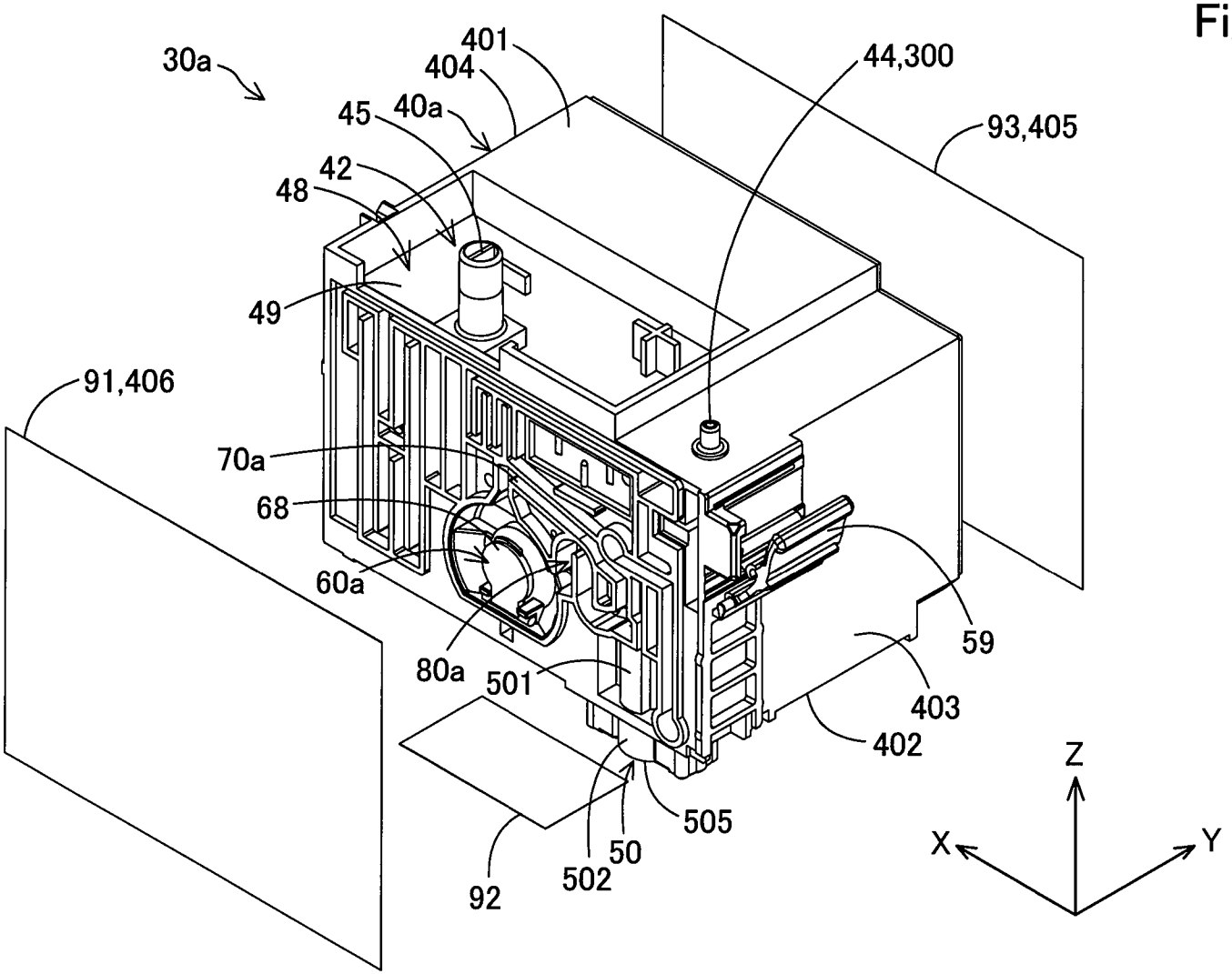
FIG. 20 is a partially exploded perspective view of the liquid tank.
Figure 21:
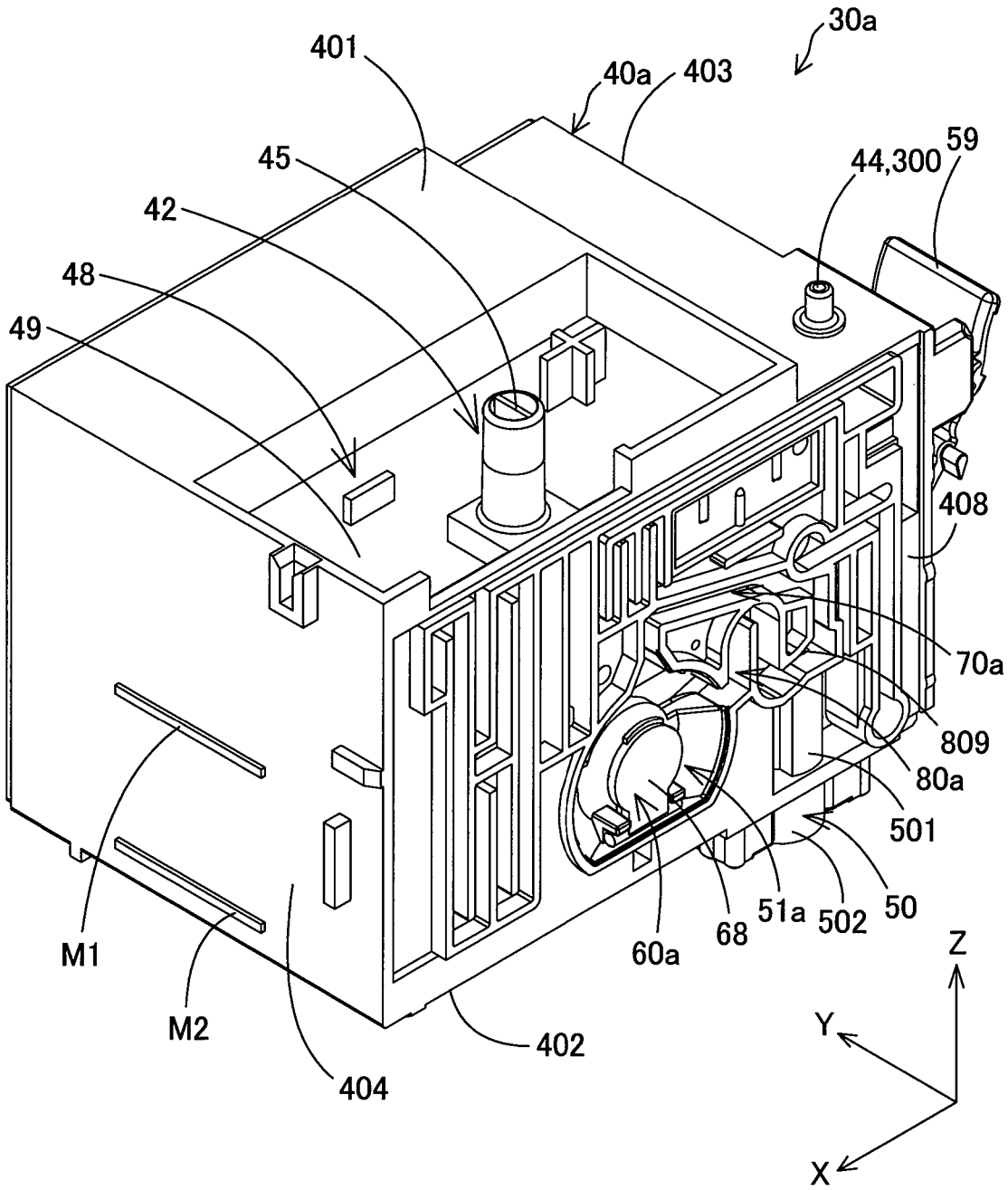
FIG. 21 is a first perspective view of a tank main body.
Figure 22:
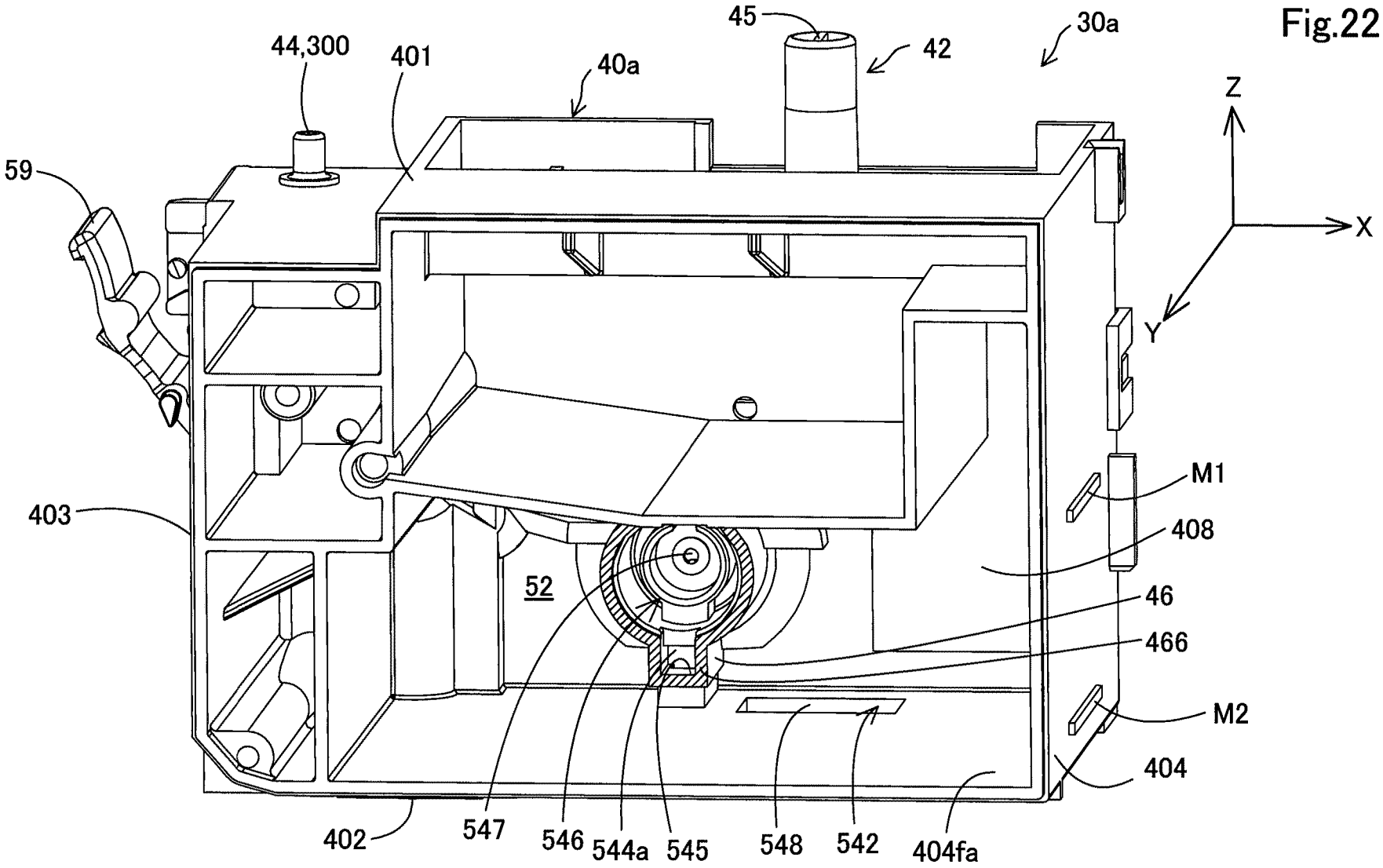
FIG. 22 is a second perspective view of the tank main body.
Figure 23:
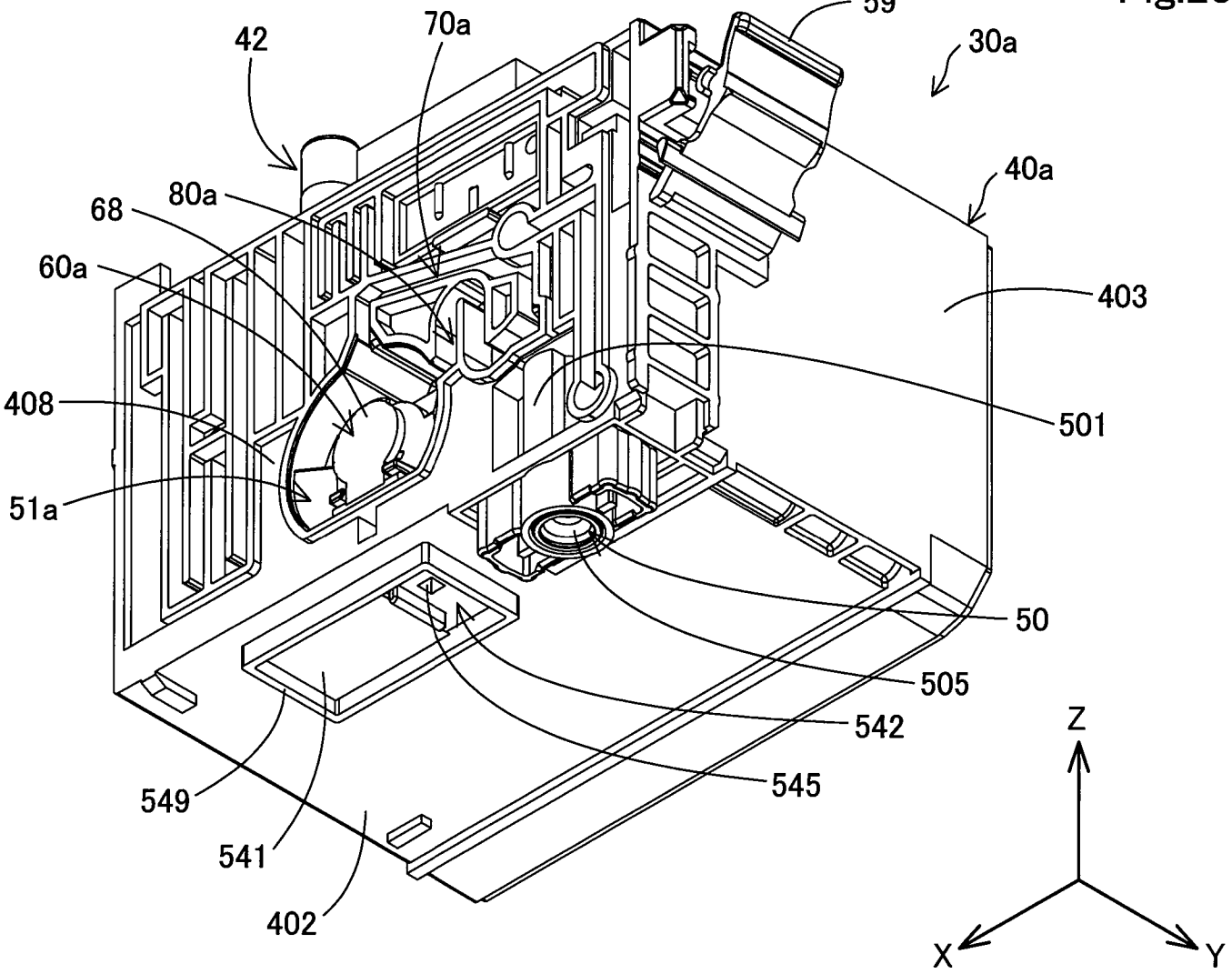
FIG. 23 is a third perspective view of the tank main body.
Figure 24:
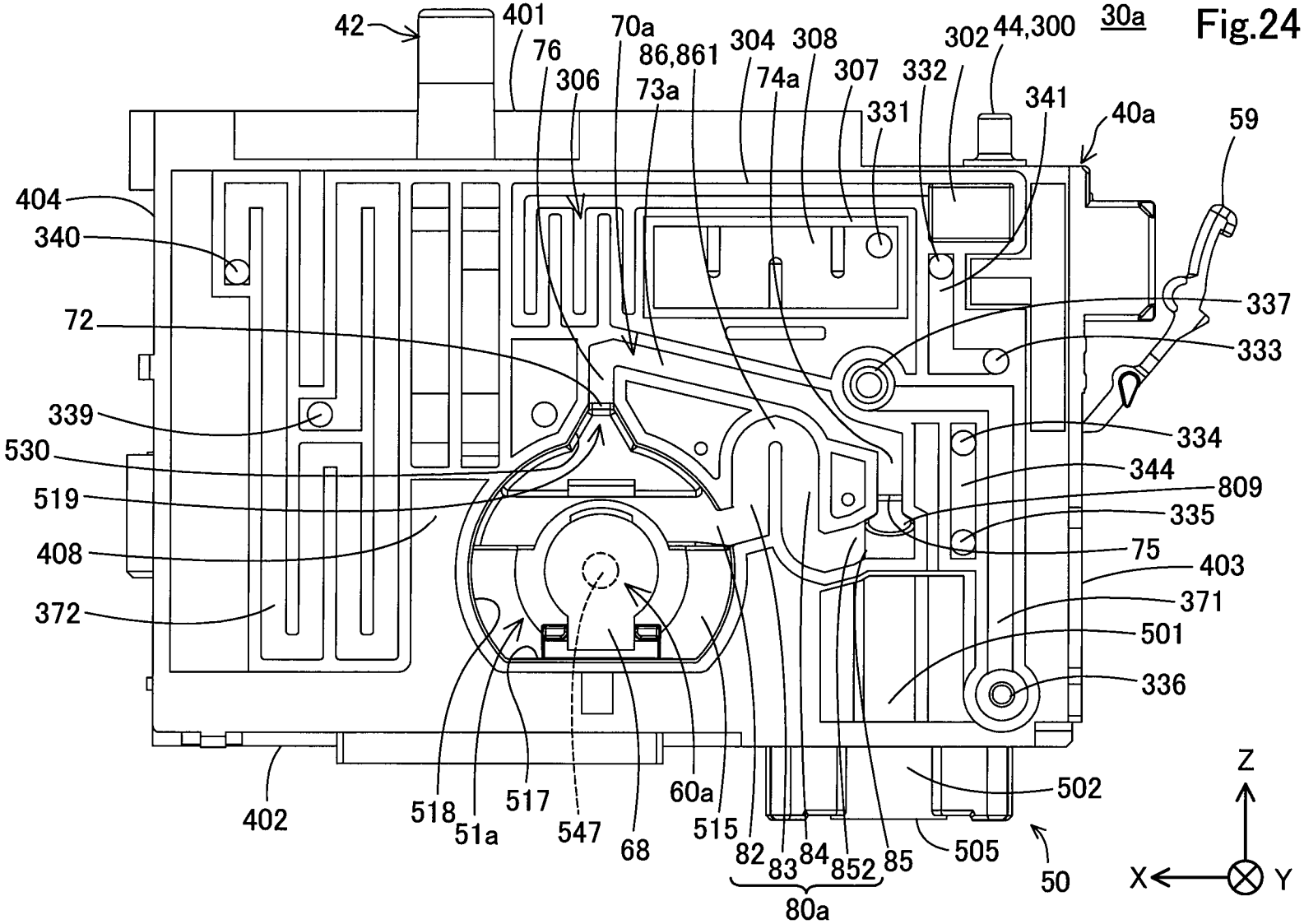
FIG. 24 is a first diagram of the tank main body seen from the minus side of the Y axis direction.
Figure 25:
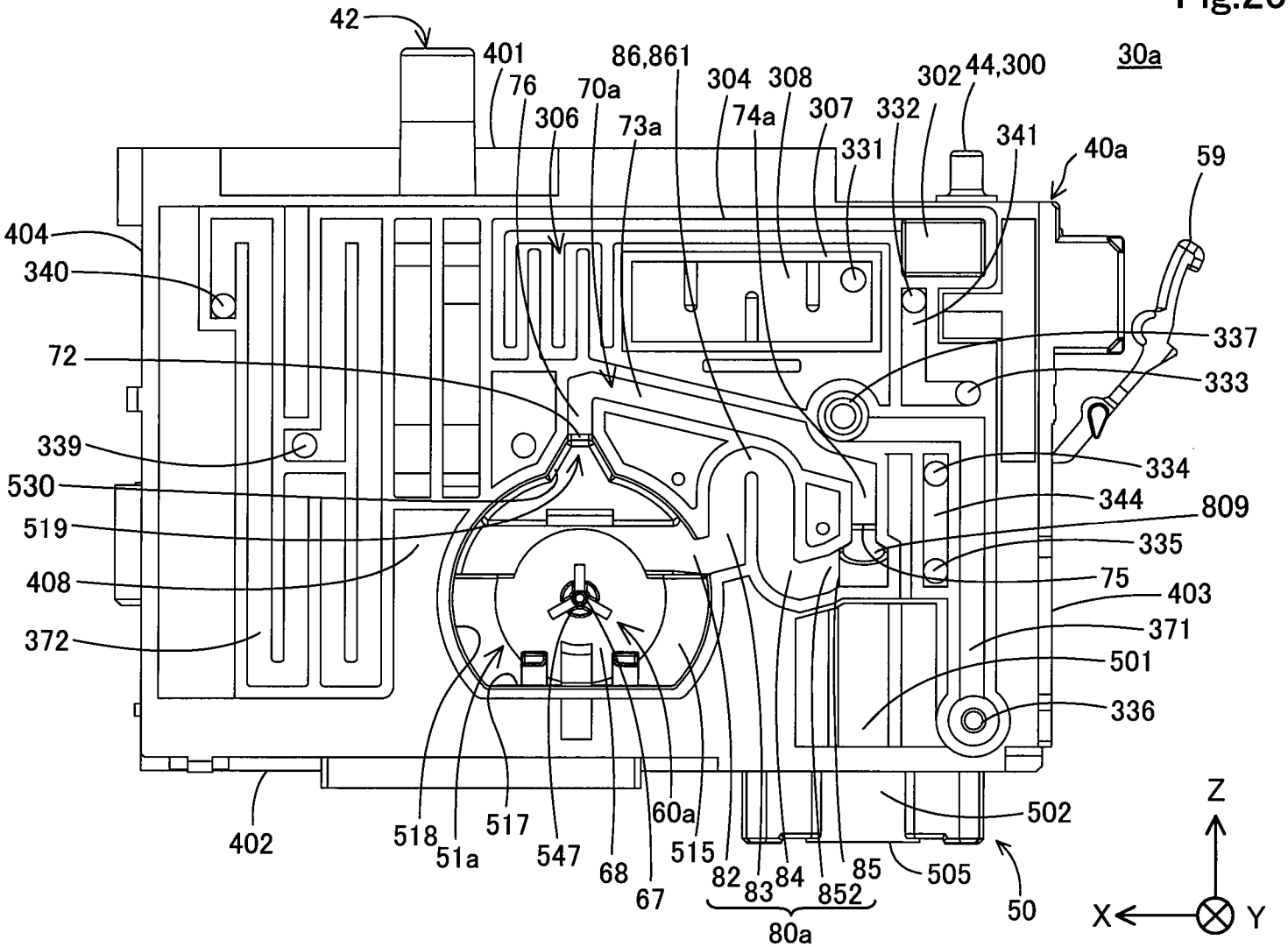
FIG. 25 is a second diagram of the tank main body seen from the minus side of the Y axis direction.
Figure 26:
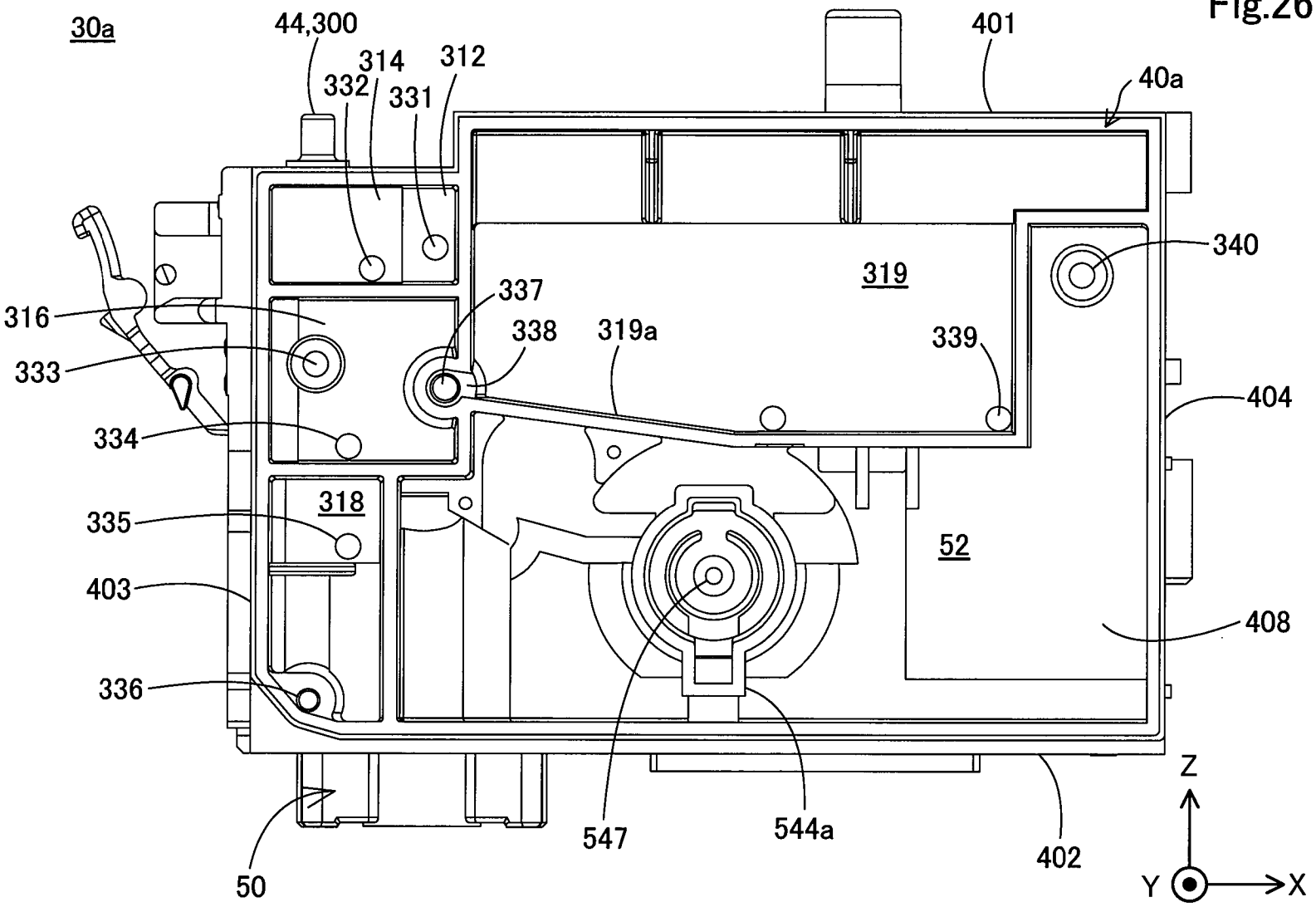
FIG. 26 is a diagram of the tank main body seen from the plus side of the Y axis direction.

FIG. 20 is a partially exploded perspective view of the liquid tank 30*a*. FIG. 21 is a first perspective view of a tank main body 40*a*. FIG. 22 is a second perspective view of the tank main body 40*a*. FIG. 23 is a third perspective view of the tank main body 40*a*. FIG. 24 is a first diagram of the tank main body 40*a* seen from the minus side of the Y axis direction. FIG. 25 is a second diagram of the tank main body 40*a* seen from the minus side of the Y axis direction. FIG. 26 is a diagram of the tank main body 40*a* seen from the plus side of the Y axis direction. FIG. 10B is a schematic view of the filter chamber 542. In FIGS. 21, 22, 23 and 24, the valve mechanism 60*a* arranged in the tank main body 40*a* is also shown. In FIG. 25, the rod 67 in the valve mechanism 60*a* is also shown.

As shown in FIG. 20, the liquid tank 30*a* includes the tank main body 40*a*, the first film 91, the second film 92 and the third film 93. The liquid tank 30*a* is formed substantially in the shape of a cuboid. In the liquid tank 30*a*, the X axis direction is a length direction, the Y axis direction is a width direction and the Z axis direction is a height direction.

The liquid tank 30*a* includes, as in the first embodiment, the upper surface (the first surface, the first wall) 401, the lower surface (the second surface, the second wall) 402, the back surface (the third surface, the third wall) 403, the front surface (the fourth surface, the fourth wall) 404, the left side surface (the fifth surface, the fifth wall) 405 and the right side surface (the sixth surface, the sixth wall) 406. The upper surface 401, the lower surface 402, the back surface 403 and the front surface 404 are formed by the tank main body 40*a*. The front surface 404 forms a visual recognition surface through which it is possible to visually recognize the water level of the liquid within the liquid tank 30*a* (specifically, the second liquid chamber 52) from the outside. For example, the front surface 404 (visual recognition surface) is formed with a transparent or translucent member. In the front surface 404, a mark (for example, a scale or a marking) corresponding to a standard (for example, an upper limit or a lower limit) for the water level (liquid surface) of the liquid may be provided. In the present embodiment, as shown in FIG. 21, an upper limit mark M1 corresponding to the upper limit and a lower limit mark M2 corresponding to the lower limit are provided on the front surface 404. For example, when the liquid is filled from the liquid filling portion 42, if the liquid surface reaches the upper limit mark M1 corresponding to the upper limit, the user stops the fillion of the liquid. For example, when the liquid surface in the liquid tank 30*a* (specifically, the second liquid chamber 52) reaches the lower limit mark M2, the user fills the liquid from the liquid filling portion 42 into the second liquid chamber 52.

The tank main body 40*a* is formed substantially in the shape of a cuboid, and is formed of a synthetic resin such as polypropylene or polystyrene. The first film 91, the second film 92 and the third film 93 are hermetically adhered to different portions of the tank main body 40*a*, respectively, so as to partition and form, together with the tank main body

40*a*, the flow paths along which the liquid and air are supplied within the liquid tank 30*a* and the like.

The tank main body 40*a* (FIG. 22) is formed in a concave shape in which the plus side of the Y axis direction is opened. The tank main body 40*a* includes one side wall 408 which forms a bottom portion of the tank main body 40*a* in the concave shape. The side wall 408 is a wall which partitions the first liquid chamber 51*a* and the second liquid chamber 52.

The side wall 408 is substantially parallel to the X axis direction and the Z axis direction. As shown in FIG. 21, on one side (the minus side of the Y axis direction) of the side wall 408, the first liquid chamber 51*a*, the liquid communication flow path 80*a* and the air communication flow path 70*a* are formed. As shown in FIG. 22, the second liquid chamber 52 is formed on the other side (the plus side of the Y axis direction) opposite to the one side of the side wall 408. In this way, the space of the liquid tank 30*a* is efficiently utilized such that it is possible to arrange the first liquid chamber 51*a*, the liquid communication flow path 80*a*, the air communication flow path 70*a* and the second liquid chamber 52, with the result that it is possible to suppress an increase in the size of the liquid tank 30*a*.

As shown in FIGS. 20 and 24, in the side wall 408, groove portions are formed so as to partition and form the air communication flow path 70*a* and the liquid communication flow path 80*a*, and concave portions are formed so as to form the first liquid chamber 51*a*. The first film 91 is hermetically adhered to the end surface of the side wall 408 on the minus side of the Y axis direction, and thus the first liquid chamber 51*a*, the air communication flow path 70*a* and the liquid communication flow path 80*a* are partitioned and formed. As shown in FIGS. 20 and 22, the third film 93 is hermetically adhered to the end surface of the tank main body 40*a* on the plus side of the Y axis direction opposite the side wall 408, and thus the second liquid chamber 52 is partitioned and formed.

The filter chamber 542 (FIG. 23) has the same configuration as in the first embodiment. The liquid which has passed through the communication opening 545 flows into the intermediate flow path 544*a*.

The intermediate flow path 544*a* and the valve arrangement chamber 546 (FIG. 22) are formed within the second liquid chamber 52. The intermediate flow path 544*a* and the valve arrangement chamber 546 are partitioned and formed by the side wall 408, the flow path wall 46 which rises from the side wall 408 toward the side of the opening of the concave-shaped tank main body 40*a* (the plus side of the Y axis direction) and the film (not shown) which is hermetically adhered to the end surface 466 of the flow path wall 46 on the plus side of the Y axis direction. The end surface 466 to which the film is adhered is single-hatched.

The intermediate flow path 544*a* (FIG. 22) is a flow path which extends in a direction along a vertical direction in the mounting state. The direction along the vertical direction is a direction which is substantially perpendicular to the horizontal direction and which forms an angle equal to or more than 80° but equal to or less than 100° with respect to the horizontal direction. The intermediate flow path 544*a* extends in the direction along the vertical direction in the mounting state, and thus it is possible to shorten the flow path length of the intermediate flow path 544*a* as compared with a case where the intermediate flow path extends in a direction intersecting the vertical direction. Here, when the liquid within the liquid tank 30*a* is consumed such that the liquid surface goes down to the position of the filter member 541, the bubbles flow into the flow path on the downstream side with respect to the filter member 541. Hence, when the liquid surface goes down to the position of the filter member 541, the supply of the liquid from the liquid tank 30*a* to the liquid ejection head 12 is stopped. In the present embodiment, the flow path length of the intermediate flow path 544*a* which connects the first liquid chamber 51*a* and the filter chamber 542 together is shortened, and thus it is possible to reduce the amount of liquid which is left within the intermediate flow path 544*a* without being used. In the other embodiment, the intermediate flow path 544*a* may be formed so as to extend in a direction which includes a horizontal direction component and a vertically upward component.

The first liquid chamber 51*a* (FIG. 24) is formed in the side wall 408, and is formed by a concave portion having the side in the horizontal direction (in the present embodiment, the minus Y axis direction) opened and the first film 91 (FIG. 20) hermetically adhered to the end surface of the concave portion on the minus side of the Y axis direction. The dimension of the first liquid chamber 51*a* in the Y axis direction is larger than that of the air communication flow path 70*a*. In other words, the depth of the first liquid chamber 51*a* is larger than that of the air communication flow path 70*a*. The volume (the maximum volume) of the first liquid chamber 51*a* is smaller than that of the second liquid chamber 52 (the maximum volume). The first liquid chamber 51*a* includes the side wall 515 which opposes the first film 91, the bottom wall 517 which is located on the side of the vertically downward direction in the mounting state, the arc-shaped circumferential wall 518 which extends, in the mounting state, from the bottom wall 517 toward the vertically upward direction, and the uppermost portion 519. The inlet opening portion 547 is formed in the side wall 515. The circumferential wall 518 includes a portion which opposes the bottom wall 517. The uppermost portion 519 is a portion which protrudes upward from a top portion and which is arranged, in the mounting state, in the highest position within the first liquid chamber 51*a*.

The uppermost portion 519 is a space which has a certain volume. The uppermost portion 519 preferably includes a tapered portion 530 whose flow path cross-sectional area decreases as the uppermost portion 519 extends toward an upper side, that is, the side of an air side connection portion 72 to which the air communication flow path 70*a* is connected. In the present embodiment, the uppermost portion 519 includes the tapered portion 530. When the uppermost portion 519 includes the tapered portion 530, as compared with a case where the uppermost portion 519 does not include the tapered portion 530, it is possible to increase the volume of the uppermost portion 519 while reducing an increase in the size of the first liquid chamber 51*a*. In this way, it is possible to increase the amount of air which is able to be stored (air storage amount) in the uppermost portion 519. Since the volume of the uppermost portion 519 is able to be increased, it is possible to suppress the flow of the liquid and the bubbles from the first liquid chamber 51*a* into the air communication flow path 70*a* caused by a variation in the environment (for example, a temperature or a pressure) in which liquid tank 30*a* is used.

The liquid communication flow path 80*a* (FIG. 24) forms, in the mounting state, a flow path which is upwardly convex. In the present embodiment, the liquid communication flow path 80*a* forms, in the mounting state, a flow path in the shape of an inverted letter U. The liquid communication flow path 80*a* includes, sequentially from the upstream side in the direction of flow of the liquid, the upstream end 82, the rising flow path 83, the liquid intermediate flow path 86, the lowering flow path 84 and a downstream end portion 852 including the downstream end 85. The flow path cross-sectional area of the liquid communication flow path 80*a* is preferably larger than that of the air communication flow path 70*a*. The flow path cross-sectional area refers to a flow path area when the flow path is cut along a plane perpendicular to the direction of flow of the fluid which is supplied within the flow path. When the flow path cross-sectional area of the liquid communication flow path 80*a* is larger than that of the air communication flow path 70*a*, as compared with a case where the flow path cross-sectional area of the liquid communication flow path 80*a* is equal to or smaller than that of the air communication flow path 70*a*, the liquid within the first liquid chamber 51*a* easily flows to the liquid communication flow path 80*a*. In the present embodiment, the flow path cross-sectional area of the narrowest place in the liquid communication flow path 80*a* is larger than that of the widest place in the air communication flow path 70*a*. Hence, the liquid tank 30*a* is able to suppress the liquid stored in the first liquid chamber 51*a* from flowing into the air communication flow path 70*a*.

The upstream end 82 is an opening which is formed in the circumferential wall 518 of the first liquid chamber 51*a*, and is connected to the first liquid chamber 51*a*. The rising flow path 83 is located on the downstream side of the upstream end 82 and extends upward in the direction of the flow in the mounting state. In the present embodiment, the rising flow path 83 extends from the upstream end 82 toward the vertically upward direction. In the other embodiment, as long as the rising flow path 83 includes an upward component, the rising flow path 83 may extend obliquely. Here, in the mounting state, the inlet opening portion 547 is arranged in a position lower than the upstream end 82. In other words, the inlet opening portion 547 is arranged in a position closer to the bottom wall 517 than the upstream end 82.

Here, since the liquid contains pigment particles, it is likely that the liquid makes contact with gas and receives a pressure variation caused by the opening and closing of the valve mechanism 60*a* and that the pigment particles are thus agglomerated so as to become foreign substances. As described above, in the mounting state, the inlet opening portion 547 is arranged in the position lower than the upstream end 82, and thus it is possible to suppress the lowering of the water level of the liquid beyond the inlet opening portion 547. Hence, it is possible to reduce the presence of gas around the inlet opening portion 547, and thus it is possible to reduce the possibility that foreign substances appear around the inlet opening portion 547. In this way, it is possible to reduce the possibility that foreign substances flow into the liquid ejection head 12.

The liquid intermediate flow path 86 connects the rising flow path 83 and the lowering flow path 84 together. The liquid intermediate flow path 86 includes a liquid side uppermost portion 861 which is, in the mounting state, the highest portion of the liquid communication flow path 80*a*. In other words, in the mounting state, the liquid intermediate flow path 86 is a portion which is higher than the upstream end 82 and the downstream end 85 forming both ends of the liquid communication flow path 80*a*. The liquid intermediate flow path 86 is a flow path which changes the flow of the liquid from the upward direction to the downward direction and which is bent 180 degrees. In the mounting state, the liquid intermediate flow path 86 is arranged in a position lower than the highest portion (the upstream end of an air second flow path 73*a*) of the air communication flow path 70*a* which will be described later.

The downstream end portion 852 is located, in the direction of the flow, on the downstream side with respect to the lowering flow path 84 and is connected to the liquid supply portion 50. The downstream end portion 852 is formed as a connection chamber which connects together the lowering flow path 84 and the liquid inlet 809 serving as the upstream end of the liquid supply portion 50 described later. The downstream end portion 852 includes the downstream end 85 to which the liquid inlet 809 is connected. In the mounting state, the downstream end portion 852 is preferably inclined with respect to the horizontal direction such that the downstream end portion 852 extends upward as the downstream end portion 852 comes closer to the liquid supply portion 50, that is, as the downstream end portion 852 extends toward the downstream end 85. The inclination of the downstream end portion 852 is more preferably an inclination in which the downstream end portion 852 is inclined at an angle equal to or more than 10° but equal to or less than 45° with respect to the horizontal direction. In the present embodiment, in the inclination of the downstream end portion 852, the downstream end portion 852 is inclined at an angle of 15° with respect to the horizontal direction. Here, the angle in the inclination of the downstream end portion 852 refers to an angle (this angle is an acute angle) which is formed by the bottom surface of the downstream end portion 852 and the horizontal direction. When the downstream end portion 852 is inclined as described above, it is possible to suppress the bubbles left within the liquid supply portion 50 from flowing into the liquid communication flow path 80*a*. Hence, it is possible to suppress the blocking of the liquid communication flow path 80*a* by the bubbles.

The air communication flow path 70*a* (FIG. 24) includes the air side connection portion 72 which forms one end, the air first flow path 76 which serves as a rising air flow path, the air second flow path 73*a* which serves as an inclined air flow path, an air third flow path 74*a* and a supply side connection portion 75 which forms the other end. In the mounting state, the air communication flow path 70*a* is connected to the first liquid chamber 51*a* in a position higher than the upstream end 82 which is a position of connection of the liquid communication flow path 80*a* and the first liquid chamber 51*a*.

The air side connection portion 72 is an opening which is formed in the uppermost portion 519 of the circumferential wall 518. In other words, in the mounting state, the air communication flow path 70*a* is connected to the uppermost portion 519 in the first liquid chamber 51*a*. In the mounting state, the air side connection portion 72 is preferably formed in the same position as the liquid side uppermost portion 861 of the liquid communication flow path 80*a* or in a position higher than the liquid side uppermost portion 861. In this case, in the first liquid chamber 51*a*, as compared with a case where the air side connection portion 72 is formed in a position lower than the liquid side uppermost portion 861, the volume of the uppermost portion 519 is able to be increased. In the present embodiment, the air side connection portion 72 is formed in a position higher than the liquid side uppermost portion 861.

In the mounting state, the air first flow path 76 includes the air side connection portion 72 at one end, and extends upward from the first liquid chamber 51*a*. The air second flow path 73*a* connects the air first flow path 76 and the air third flow path 74*a* together, and extends, in the mounting state, in a direction which includes a horizontal direction component (in the present embodiment, the X axis direction). In the mounting state, the air third flow path 74*a* extends downward from the air second flow path 73*a*. The air third flow path 74*a* is connected through the supply side connection portion 75 to the liquid supply portion 50. The supply side connection portion 75 is formed as a connection chamber which connects the air third flow path 74*a* and the liquid inlet 809 together.

The air second flow path 73*a* is preferably a flow path which extends, in the mounting state, in a direction that is inclined with respect to the horizontal direction. The air second flow path 73*a* is more preferably inclined at an angle equal to or more than 10° but equal to or less than 45° with respect to the horizontal direction. Here, the angle of the air second flow path 73*a* with respect to the horizontal direction refers to an angle (this angle is an acute angle) which is formed by the bottom surface of the air second flow path 73*a* and the horizontal direction. The air second flow path 73*a* extends in the direction that is inclined with respect to the horizontal direction, and thus as compared with a case where the air second flow path extends along the horizontal direction, when the liquid flows into the air second flow path 73*a*, the liquid which has flowed thereinto easily flows from the air second flow path 73*a* into the air first flow path 76 or the air third flow path 74*a*. Hence, it is possible to suppress the liquid flowing into the air second flow path 73*a* from being retained in the air second flow path 73*a*. Thus, it is possible to suppress the blocking of the air second flow path 73*a* by the liquid flowing into the air second flow path 73*a*. The flow of the liquid into the air second flow path 73*a* is caused by, for example, a change in the temperature or the atmospheric pressure or the inversion or vibration of the liquid tank 30*a*. In the present embodiment, in the mounting state, as the air second flow path 73*a* comes closer to the air third flow path 74*a*, the entire flow path is inclined downward and has an angle of 15° with respect to the horizontal direction.

In the mounting state, the supply side connection portion 75 which is the downstream end of the air communication flow path 70*a* is preferably located immediately above the liquid inlet 809 of the liquid supply portion 50 which will be described later. The location immediately thereabove means that, when the supply side connection portion 75 is seen in the Z axis direction, the supply side connection portion 75 and the liquid inlet 809 are arranged such that at least parts thereof overlap each other. The supply side connection portion 75 and the liquid inlet 809 are more preferably arranged such that the center of the cross section of the flow path in the supply side connection portion 75 is substantially overlaid on the center of the cross section of the flow path in the liquid inlet 809. When the supply side connection portion 75 is located immediately above the liquid inlet 809, as compared with a case where the supply side connection portion 75 is not located immediately above the liquid inlet 809, the bubbles left in the liquid supply portion 50 are raised so as to easily flow into the air communication flow path 70*a*. In this way, the bubbles left in the liquid supply portion 50 are suppressed from flowing into the liquid communication flow path 80*a*. In the present embodiment, the supply side connection portion 75 is located immediately above the liquid inlet 809.

The liquid supply portion 50 (FIG. 24) has the same configuration as in the first embodiment, and for example, the first supply portion 501 is formed within the tank main body 40*a*.

As shown in FIG. 24, when the liquid tank 30*a* is seen from one side (the minus side of the Y axis direction) of the side wall 408, as in the first embodiment, the liquid filling portion 42 and the liquid supply port 505 are arranged in diagonal positions. For example, when the liquid tank 30*a* is seen from one side (the minus side of the Y axis direction) of the side wall 408, the liquid filling portion 42 is located, in the mounting state, on the vertically upward side with respect to the first liquid chamber 51*a* and on one side (for example, the plus side of the X axis direction) in the horizontal direction (for example, the X axis direction) with respect to the inlet opening portion 547 of the first liquid chamber 51*a*.

The initial charging of the liquid to the liquid tank 30*a* is the same as in the first embodiment described above, and is the same as the description using FIGS. 11 to 13. The liquid tank 30*a* after the initial charging of the liquid is the same as in the first embodiment, and is the same as the description using FIGS. 14 to 18.

According to the second embodiment described above, with regard to the same configurations as in the first embodiment, the same effects are achieved. For example, in the mounting state, the liquid supply portion 50 is located lower than the downstream end 85 and extends downward toward the liquid supply port 505 (FIG. 24). In this way, it is possible to suppress an increase in the size of the liquid tank 30 in the horizontal direction. Moreover, in this way, it is possible to smoothly supply the liquid from the liquid supply portion 50 to the liquid ejection head 12, and thus it is possible to efficiently supply the liquid to the liquid ejection head 12.

C. Variations

This disclosure is not limited to the examples and embodiments described above and is able to be practiced in various aspects without departing from the spirit thereof, and the following variations are possible, for example.

C-1. First Variation:

The present disclosure is not limited to an inkjet printer and a liquid tank for supplying an ink to an inkjet printer, and is also able to be applied to an arbitrary liquid ejection apparatus which ejects a liquid other than ink and a liquid tank for storing the liquid. For example, the present disclosure is able to be applied to various types of liquid ejection apparatuses and liquid tanks thereof which will be as described below.

(1) An image recording device such as a facsimile device (2) A color material ejection device which is used in the manufacturing of a color filter for an image display device such as a liquid crystal display (3) An electrode material ejection device which is used in the formation of an electrode in an organic EL (Electro Luminescence) display, a field emission display (FED) or the like (4) A liquid ejection apparatus that ejects a liquid which is used in the manufacturing of a biochip and which contains a bioorganic substance (5) A sample ejection device which severs as a precision pipette (6) A lubricant ejection device (7) A resin liquid ejection apparatus (8) A liquid ejection apparatus which ejects a lubricant with pinpoint accuracy to a precision machine such as a watch or a camera (9) A liquid ejection apparatus that ejects, on a substrate, a transparent resin liquid such as an ultraviolet curable resin liquid in order to form a micro-hemispheric lens (optical lens) used in an optical communication element or the like

(10) A liquid ejection apparatus which ejects an acidic or alkaline etching liquid in order to etch a substrate or the like

(11) A liquid ejection apparatus which includes a liquid ejection head for discharging a small amount of other arbitrary droplets A "droplet" refers to the state of the liquid which is discharged from the liquid ejection apparatus, and includes a particle shape, a teardrop shape and a shape leaving a thread-shaped trail. The "liquid" mentioned here may be any material in a state that is able to be ejected by the liquid ejection apparatus. For example, the "liquid" may be any material in a state where the material is in a liquid phase, and also includes a material whose viscosity is high or low, sols, gel water and other materials in a liquid state such as an inorganic solvent, an organic solvent, a solution, a liquid resin, a liquid metal (metal melt). The "liquid" includes not only liquids in one state of matter but also the particles of functional materials consisting of solid substances such as a pigment or metal particles which are dissolved, dispersed or mixed in solvents. Typical examples of the liquid include the ink as described in the embodiments discussed above and liquid crystal. The ink here includes general water-based inks and oil-based inks and various types of liquid compositions such as a gel ink and a hot melt ink.

C-2. Second Variation:

Although in the second embodiment, the entire flow path is inclined downward (FIG. 24) as the air second flow path 73*a* serving as the inclined flow path of the air communication flow path 70 comes closer to the air third flow path 74*a* in the mounting state, there is no limitation to this configuration. For example, not the entire air second flow path 73*a* but only the bottom surface of the air second flow path 73*a* may be inclined. The air second flow path 73*a* may be inclined upward as the air second flow path 73*a* comes closer to the air third flow path 74*a* in the mounting state. Even in these cases, as in the first embodiment, it is possible to suppress the liquid flowing into the air second flow path 73*a* from being retained within the air second flow path 73*a*. Hence, it is possible to suppress the blocking of the air second flow path 73*a* by the liquid flowing into the air second flow path 73*a*.

The present disclosure is not limited to the embodiments, examples and variations described above and is able to be realized in various configurations without departing from the spirit thereof. For example, the technical features in the embodiments, examples and variations corresponding to the technical features in the aspects described in the Summary are able to be replaced or combined as necessary so as to solve part or the whole of the problems described above or to achieve part or the whole of the effects described above. When the technical features are not described in the present specification as mandatory, they are able to be removed as necessary.

What is claimed is:

1. A liquid tank which is mounted to a carriage including a liquid ejection head, the liquid tank comprising:

a liquid supply portion which includes a liquid supply port configured to receive a liquid introduction needle included in the liquid ejection head;

a first liquid chamber configured to store a liquid to be supplied to the liquid supply portion;

a second liquid chamber configured to store liquid to be supplied to the first liquid chamber;

a liquid filling portion configured to fill the liquid to be supplied to the first liquid chamber into the second liquid chamber;

a liquid communication flow path through which the first liquid chamber is in fluid communication with the liquid supply portion, the liquid communication flow path forming a flow path that is upwardly convex in a mounting state where the liquid tank is mounted to the carriage;

an air communication flow path through which the first liquid chamber is in communication with the liquid supply portion, the air communication flow path connected to the first liquid chamber in a position higher than a position of connection of the liquid communication flow path and the first liquid chamber in the mounting state;

a connection flow path which connects the first liquid chamber and the second liquid chamber together and which is configured to supply the liquid stored in the second liquid chamber to the first liquid chamber; and an atmosphere communication portion configured to make the second liquid chamber communicate with the atmosphere, wherein in a direction of flow of the liquid from the liquid tank toward the liquid ejection head, the liquid communication flow path includes:

an upstream end which is connected to the first liquid chamber;

a rising flow path which is located on a downstream side with respect to the upstream end and which extends upward in the mounting state;

a lowering flow path which is located on the downstream side with respect to the rising flow path and which extends downward in the mounting state; and a downstream end which is located on the downstream side with respect to the lowering flow path and which is connected to the liquid supply portion, and in the mounting state, the liquid supply portion is located lower than the downstream end and extends downward toward the liquid supply port.

2. The liquid tank in accordance with claim 1, wherein the connection flow path includes an inlet opening portion which forms one end and which is connected to the first liquid chamber, the liquid tank further includes a valve mechanism which opens and closes the inlet opening portion so as to control flow of the liquid from the second liquid chamber into the first liquid chamber and the inlet opening portion is arranged in a position lower than the upstream end in the mounting state.

3. The liquid tank in accordance with claim 2, wherein the valve mechanism is brought into an opened state at least when an interior of the first liquid chamber has a negative pressure.

4. The liquid tank in accordance with claim 1, wherein the first liquid chamber is smaller in volume than the second liquid chamber.

5. The liquid tank in accordance with claim 1, further comprising:

a tank main body which includes a wall, wherein the first liquid chamber, the liquid communication flow path and the air communication flow path are formed on one side of the wall, and the second liquid chamber is formed on another side opposite to the one side of the wall.

6. The liquid tank in accordance with claim 5, wherein when the liquid tank is seen from the one side of the wall, the liquid filling portion and the liquid supply port are arranged in diagonal positions.

7. The liquid tank in accordance with claim 1, wherein the connection flow path includes a filter chamber which is connected to the second liquid chamber and which is located lower than the second liquid chamber in the mounting state, and the filter chamber includes, in the mounting state:

an inflow opening which is connected to the second liquid chamber; and a filter member which partitions the filter chamber into a first portion that is located in an upper side including the inflow opening and a second portion that is located in a lower side with respect to the first portion and which is located lower than the inflow opening.

8. The liquid tank in accordance with claim 1, wherein the air communication flow path is connected to an uppermost portion of the first liquid chamber in the mounting state.

9. The liquid tank in accordance with claim 1, wherein the air communication flow path includes an air side connection portion which is connected to the uppermost portion of the first liquid chamber, and in the mounting state, a position of the air side connection portion is the same position as a liquid side uppermost portion which is the highest position of the liquid communication flow path or is a position higher than the liquid side uppermost portion.

10. The liquid tank in accordance with claim 9, wherein the liquid side uppermost portion includes a tapered portion whose flow path cross-sectional area decreases as the tapered portion extends upward in the mounting state.

11. The liquid tank in accordance with claim 1, wherein in the mounting state, the air communication flow path includes a rising air flow path which extends upward from the first liquid chamber and an inclined air flow path which is connected to the rising air flow path and which extends in a direction that is inclined with respect to a horizontal direction.

12. The liquid tank in accordance with claim 11, wherein in the mounting state, the inclined air flow path is inclined at an angle equal to or more than 10° but equal to or less than 45° with respect to the horizontal direction.

13. The liquid tank in accordance with claim 1, wherein flow path cross-sectional area of the liquid communication flow path is larger than that of the air communication flow path.

14. The liquid tank in accordance with claim 1, wherein in the mounting state, a downstream end of the air communication flow path is located immediately above the liquid supply portion.

15. The liquid tank in accordance with claim 1, wherein in the mounting state, a downstream end portion including the downstream end of the liquid communication flow path is inclined with respect to the horizontal direction such that the downstream end portion extends upward as the downstream end portion comes closer to the liquid supply portion.

16. The liquid tank in accordance with claim 15, wherein in the mounting state, the downstream end portion is inclined at an angle equal to or more than 10° but equal to or less than 45° with respect to the horizontal direction.

17. The liquid tank in accordance with claim 1, further comprising:

a second liquid chamber which communicates with the first liquid chamber and configured to store the liquid to be supplied to the first liquid chamber;

a filter chamber which is connected through a filter to a bottom surface of the second liquid chamber and which is located lower than the second liquid chamber in the mounting state,; and an intermediate flow path which connects the first liquid chamber and the filter chamber together, wherein in the mounting state, the intermediate flow path includes a flow path which extends in a direction along a vertical direction.

* * * * *